US007631861B2

(12) United States Patent
Takahashi

(10) Patent No.: US 7,631,861 B2
(45) Date of Patent: Dec. 15, 2009

(54) SHEET FEEDING DEVICE AND IMAGE FORMING APPARATUS

(75) Inventor: Hironori Takahashi, Osaka (JP)

(73) Assignee: Kyocera Mita Corporation (JP)

( * ) Notice: Subject to any disclaimer, the term of this patent is extended or adjusted under 35 U.S.C. 154(b) by 420 days.

(21) Appl. No.: 11/486,857

(22) Filed: Jul. 14, 2006

(65) Prior Publication Data

US 2007/0013760 A1 Jan. 18, 2007

(30) Foreign Application Priority Data

Jul. 15, 2005 (JP) ..... 2005-206763
Jul. 15, 2005 (JP) ..... 2005-207272
Jul. 15, 2005 (JP) ..... 2005-207289

(51) Int. Cl.
*B65H 3/44* (2006.01)
*B65H 1/00* (2006.01)

(52) U.S. Cl. ..... 271/9.09; 271/241; 271/171

(58) Field of Classification Search ..... 271/9.09, 271/241, 171; 399/392, 393
See application file for complete search history.

(56) References Cited

U.S. PATENT DOCUMENTS 3,061,303 A * 10/1962 Glaser et. al. ..... 271/171
4,457,507 A * 7/1984 Ishikawa et al. ..... 271/121
4,907,792 A * 3/1990 Washiashi et al. ..... 271/240
5,215,303 A * 6/1993 Yamada et al. ..... 271/240

FOREIGN PATENT DOCUMENTS

JP 3270613 1/2002

* cited by examiner

*Primary Examiner*—David H Bollinger
(74) *Attorney, Agent, or Firm*—Gerald E. Hespos; Anthony J. Casella

(57) ABSTRACT

A sheet feeding device for manually feeding a sheet to a specified apparatus such as an image forming apparatus is provided with a manual feed tray for guiding a sheet being manually fed, and a pair of cursors provided on the manual feed tray and movable in opposite directions along a sheet width direction normal to a sheet conveyance direction in accordance with the width of the sheet. The pair of cursors are operable such that the front end positions and/or the rear end positions thereof with respect to the sheet conveyance direction are shifted along the sheet conveyance direction.

20 Claims, 21 Drawing Sheets

SHEET FEEDING DEVICE AND IMAGE FORMING APPARATUS

BACKGROUND OF THE INVENTION

1. Field of the Invention

The present invention relates to a feed feeding device used to manually feed sheets to various sheet processing apparatuses and image forming apparatuses as exemplified by copiers, facsimile apparatuses, and printers, and an image forming apparatus using the same.

2. Description of the Related Art

There have been conventionally known sheet feeding devices for feeding a sheet as a transfer material to a transfer device of an image forming apparatus as disclosed in Japanese Patent No. 3270613. This sheet feeding device is provided with a sheet cassette detachably attached to an apparatus main body of the image forming apparatus for storing a plurality of sheets of definite size, and a manual feeding portion disposed above this sheet cassette and used when small-size sheets such as postcards or sheets of indefinite size are manually fed one by one.

The manual feeding portion includes a plate-shaped sheet table on which sheets can be placed and a pair of cursors provided on this sheet table and adapted to guide the sheets so that the sheets can be fed straight. The sheet table is detachably attachable to the sheet cassette, and can change its posture between a vertical posture where the sheet table is accommodated in the sheet cassette and a horizontal posture where it is withdrawn from the sheet cassette. Upon manually feeding a sheet, the sheet table is withdrawn from the sheet cassette and set in the horizontal posture. Then, a spacing between the pair of cursors is adjusted in conformity with the width of the sheet, and the sheet is manually fed while being guided by these cursors. The manually fed sheet directly reaches a registration roller disposed at an upstream end of an image forming assembly, whereby the manual sheet feeding can be smoothly carried out. When no manual sheet feeding is carried out, the sheet table is accommodated in the vertical posture in the sheet cassette, wherefore there is no likelihood of a problem that the projecting sheet table stands in the way.

However, since the pair of cursors cannot be extended up to positions located inside the apparatus main body due to the set positions thereof in the sheet feeding device disclosed in Japanese Patent No. 3270613, these cursors are provided only at the side of a feed opening. Accordingly, no particular problem arises when a standard sheet of, e.g. A4 is manually fed, but a small-size sheet can be guided by the cursors only at a downstream position with respect to a sheet conveyance direction when the small-size sheet such as a postcard is manually fed. This makes it difficult to feed the sheet straight, resulting in a problem that the sheet may be obliquely fed.

SUMMARY OF THE INVENTION

An object of the present invention is to provide a sheet feeding device capable of securely feeding a sheet regardless of the size of the sheet to be manually fed and an image forming apparatus to which such a sheet feeding device is applied.

In order to accomplish the above object, one aspect of the present invention is directed to a sheet feeding device for manually feeding a sheet into a specified apparatus, comprising a manual feed tray for guiding a sheet being manually fed; and a pair of cursor members provided on the manual feed tray and movable in opposite directions along a sheet width direction normal to a sheet conveyance direction in accordance with the width of a sheet, the pair of cursor members being operable such that the front end positions and/or the rear end positions thereof with respect to the sheet conveyance direction are shifted along the sheet conveyance direction.

With such a construction, the cursor members can be set in conformity with not only the width of the sheet, but also the length of the sheet along the sheet conveyance direction since the front end positions and/or the rear end positions thereof with respect to the sheet conveyance direction can be shifted.

These and other objects, features, aspects and advantages of the present invention will become more apparent upon a reading of the following detailed description and accompanying drawings.

BRIEF DESCRIPTION OF THE DRAWINGS

FIGS. 1A, 1B are perspective views showing one embodiment of a printer to which a sheet feeding device according to the invention is applied, wherein FIG. 1A shows a state where a movable tray of a manual feeding portion is set in an accommodated posture and FIG. 1B shows a state where the movable tray is set in a withdrawn posture, FIGS. 9A to 9C are plan views of a manual feed tray showing functions of the manual feeding portion according to the first embodiment, wherein FIG. 9A shows a state where the pair of cursors are set at normal positions, FIG. 9B shows a state reached by moving the pair of cursors to positions having a minimum spacing therebetween, and FIG. 9C shows a state where the pair of cursors are set at downstream positions, FIGS. 13A to 13C are plan views of a manual feed tray showing functions of a manual feeding portion according to the second embodiment, wherein FIG. 13A shows a state where the pair of cursors are set at normal positions, FIG. 13B shows a state reached by moving the pair of cursors to positions having a minimum spacing therebetween, and FIG. 13C shows a state where the pair of cursors are set at downstream positions, FIGS. 14A and 14B are perspective views showing a printer to which a sheet feeding device according to a third embodiment is applied, wherein FIG. 14A shows a state where a movable tray of a manual feeding portion is set in an accommodated posture and FIG. 14B shows a state where the movable tray is set in a withdrawn posture, FIGS. 18A and 18B are sections of a manual feed tray showing functions of the manual feeding portion according to the third embodiment, wherein FIG. 18A shows a state where the movable tray is set in the accommodated posture and FIG. 18B shows a state where the movable tray is set in the withdrawn posture, FIGS. 21A to 21C are plan views of a manual feed tray showing functions of a manual feeding portion according to the fourth embodiment, wherein FIG. 21A shows a state where a feed-opening side cursors are set in closed postures, FIG. 21B shows an intermediate state during a change of the postures of the feed-opening side cursors form the closed postures to opened postures, and FIG. 21C shows a state where the feed-opening side cursors are changed to the opened postures.

DETAILED DESCRIPTION OF THE PREFERRED EMBODIMENTS

Hereinafter, embodiments of the present invention are described with reference to the accompanying drawings.

First Embodiment

Figure 1A:
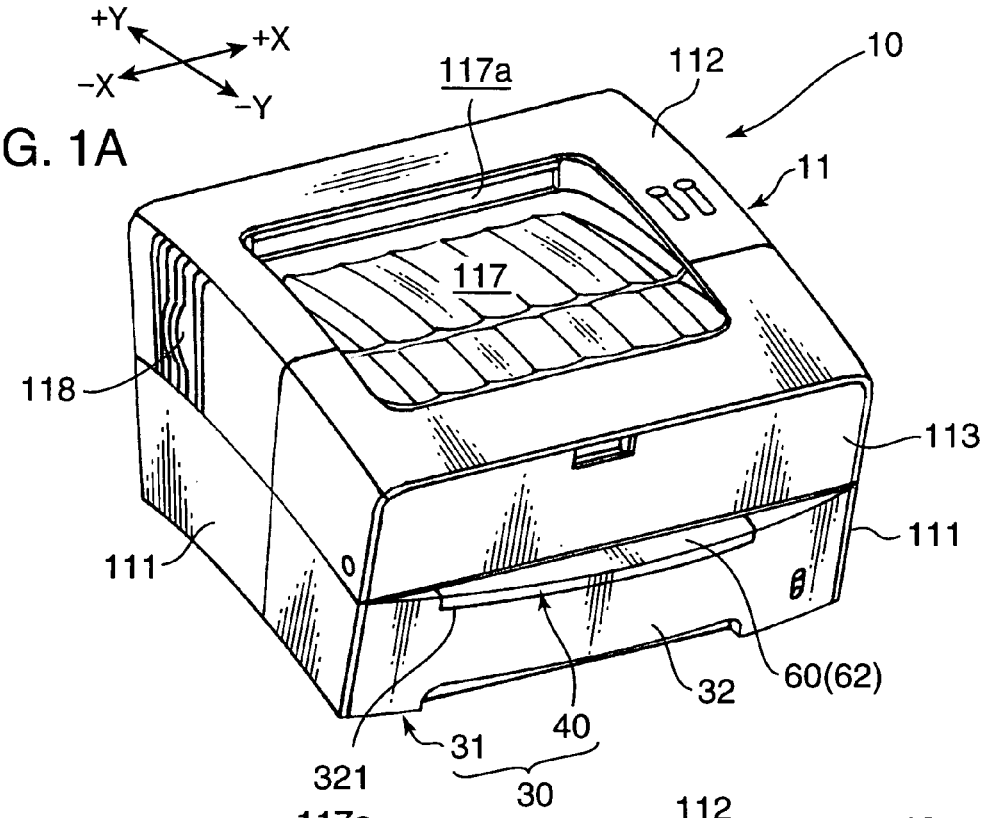
Figure 1B:
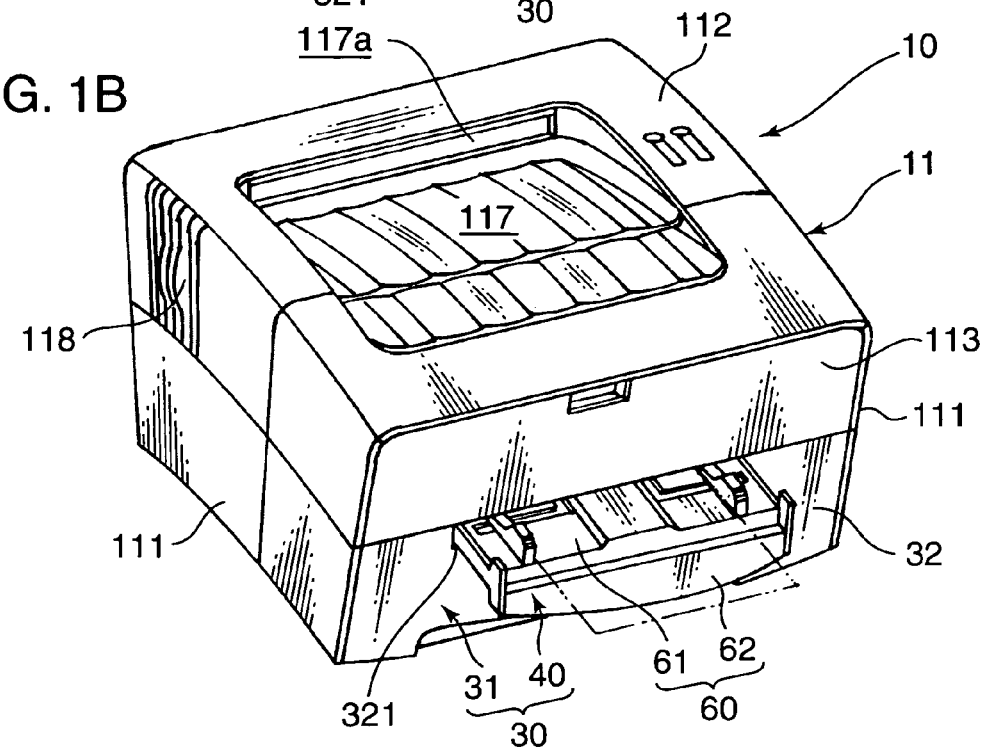

FIGS. 1A, 1B are perspective views showing one embodiment of a printer to which a sheet feeding device according to the invention is applied, wherein FIG. 1A shows a state where a movable tray of a manual feeding portion is set in an accommodated posture and FIG. 1B shows a state where the movable tray is set in a withdrawn posture. It should be noted that, in FIGS. 1A and 1B, X-X directions are referred to as transverse directions and Y-Y directions are referred to as forward and backward directions, particularly −X direction being leftward direction, +X direction being right ward direction, −Y direction being forward direction and +Y direction being backward direction.

As shown in FIG. 1, a printer (image forming apparatus) 10 forms an image based on image information inputted from an external apparatus, for example, as exemplified by a computer and transfers the formed image to a sheet P. The printer 10 is constructed such that various devices used for image formation are installed in a box-shaped apparatus main body 11 having a convex arcuate top contour in side view.

The apparatus main body 11 is provided with a pair of left and right fan-shaped side plates 111 facing each other along width direction, a ceiling plate 112 mounted between the upper edges of the side plates 111 and arch-shaped in side view, a front plate 113 extending down from the front edge of the ceiling plate 112 substantially up to a vertical middle position, a rear plate 114 (see FIG. 2) extending down from the rear edge of the ceiling plate 112 substantially up to the vertical middle position, and a partition plate 115 (see FIG. 2) mounted between the side plates 111 substantially at the vertical middle position. Various devices for image formation to be described later are installed above the partition plate 115 in the apparatus main body 11. Further, a sheet cassette 31 to be described in detail later is detachably attached below the partition plate 115.

An arched front plate 32 of the sheet cassette 31 to be described later is provided below the front plate 113, and the upper edge thereof is cut to form a recessed groove 321 having a specified vertical dimension and extending in transverse direction. A manual feeding portion 40 to be described later is detachably mountable in this recessed groove 321. In the case of manual sheet feeding, a sheet P is introduced into the apparatus main body 11 via the manual feeding portion 40 withdrawn from the recessed groove 321.

The ceiling plate 112 has a middle part thereof recessed in such a manner as to be inclined down toward the back, thereby providing a discharge tray 117. A sheet P having a specified image transfer performed thereto in the apparatus main body 11 is discharged onto the discharge tray 117 via a discharge opening 117*a* formed in the rear wall of the discharge tray 117.

A louver 118 formed by arranging a plurality of vertically extending slits defined between adjacent fins in forward and backward directions is provided at an upper rear part of each side plate 111. Cooling is applied to the apparatus main body 11 by discharging the outside air taken into one louver 118 from the other louver 118.

Figure 2:
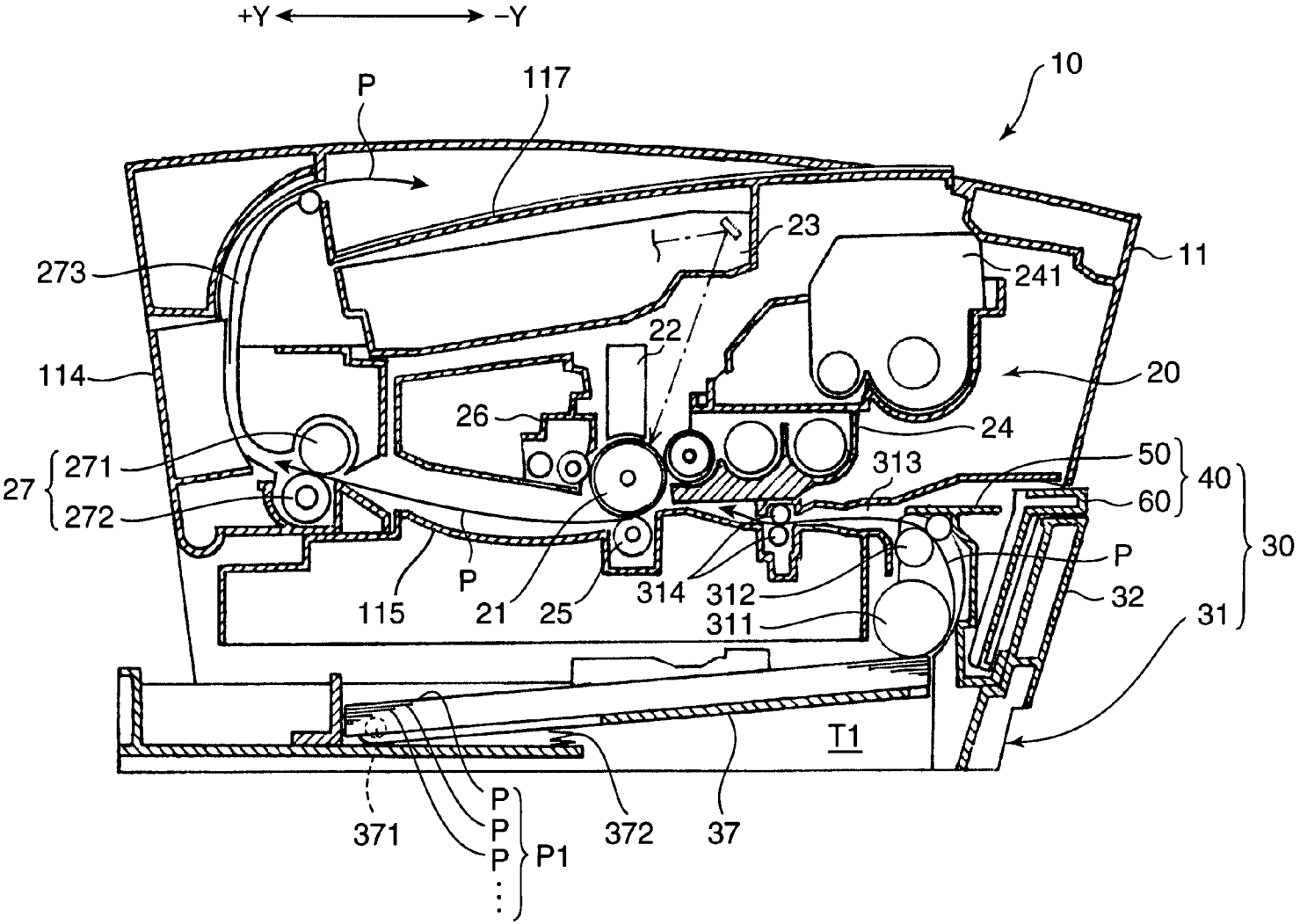
FIG. 2 is a side view in section showing an overview of the internal construction of the printer with a sheet cassette accommodated at an accommodated position.
Figure 3:
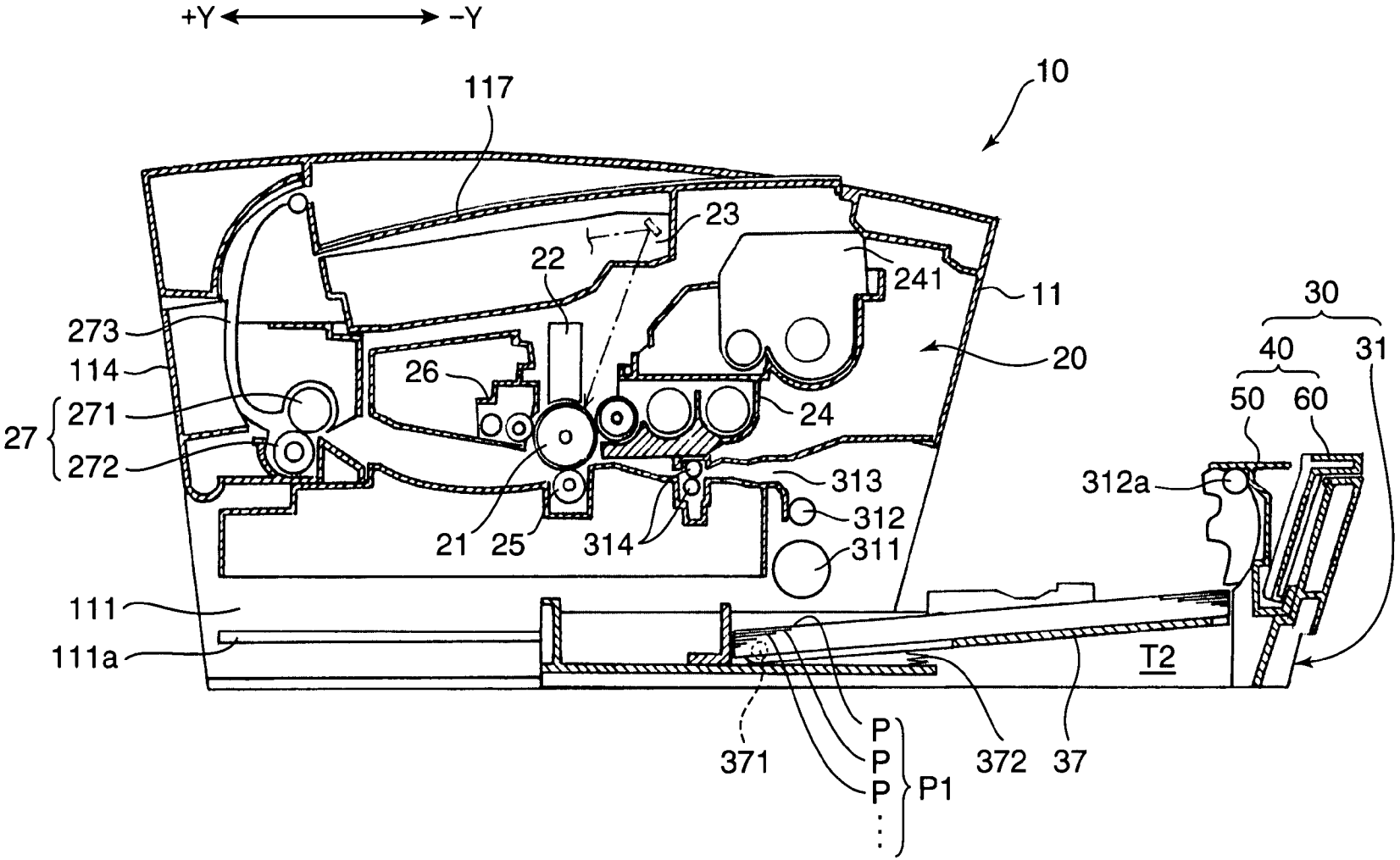
FIG. 3 is a side view in section showing an overview of the internal construction of the printer with the sheet cassette withdrawn to a withdrawn position.

FIGS. 2 and 3 are side views in section showing an overview of the internal construction of such a printer 10. FIG. 2 shows a state where the sheet cassette 31 is accommodated at an accommodated position T1 and FIG. 3 shows a state where the sheet cassette 31 is withdrawn to a withdrawn position T2. Directions shown by Y (forward and backward directions) in FIGS. 2 and 3 are the same as in the case of FIG. 1 (−Y: forward, +Y: backward).

As shown in FIGS. 2 and 3, the printer 10 includes a sheet feeding device 30 arranged below the partition plate 115, an image transfer device (transfer device) 20 and a fixing device 27 installed at positions above the partition plate 115 in the apparatus main body 11. The sheet feeding device 30 is so constructed as to store sheets P used for printing, to dispense the sheets P one by one from a bunch of the stored sheets P (sheet bunch P1), and to enable a sheet to be manually fed. The image transfer device 20 transfers an image to the sheet P fed from this sheet feeding device 30. The fixing device 27 fixes the image to the sheet P having the image transferred thereto in the image transfer device 20. The sheet P having the image fixed by the fixing device 27 is discharged onto the discharge tray 117.

The sheet feeding device 30 is provided with the sheet cassette 31 detachably attached to the apparatus main body 11 for storing the sheet bunch P1, and the manual feeding portion 40 disposed above the sheet cassette 31. In the apparatus main body 11, a large-diameter feed roller 311 capable of dispensing the sheets P one by one from the sheet bunch P1 is disposed at a position corresponding to an upstream side (right side in FIG. 2) of the sheet cassette 31, and a small-diameter conveying roller 312 is disposed at a position right above the feed roller 311. On the other hand, the sheet cassette 31 is provided with a feed roller 312*a* to be opposed to the conveying roller 312, and a pair of feed rollers is formed by these conveying rollers 312, 312*a*. The sheet P dispensed from the sheet cassette 31 by driving the feed roller 311 is fed to the image transfer device 20 via the conveying rollers 312, 312*a*, a sheet conveyance path 313 and a pair of registration rollers 314 disposed at the downstream end of the sheet conveyance path 313. It should be noted that the sheet cassette 31 and the manual feeding portion 40 are described in detail later.

The image transfer device 20 transfers an image to the sheet P based on image information electrically transmitted from a computer or the like. The image transfer device 20 is constructed by arranging a charger 22, an exposing device 23, a developing device 24, a transfer roller 25 and a cleaning device 26 in clockwise direction around the outer circumferential surface of a photosensitive drum 21 rotatable about a central axis thereof extending in transverse direction (direction normal to the plane of FIG. 2) from a position right above the photosensitive drum 21.

The photosensitive drum 21 forms an electrostatic latent image and a toner image conforming to this electrostatic latent image on the outer circumferential surface thereof. An amorphous silicon layer is formed on the outer circumferential surface of the photosensitive drum 21, thereby making it suitable to form these images on this outer circumferential surface.

The charger 22 is for uniformly charging the outer circumferential surface of the photosensitive drum 21 rotating in clockwise direction about its central axis with electric charges. In this embodiment is employed a charger of the corona discharge type for imparting electric charges to the outer circumferential surface of the photosensitive drum 21 by means of a corona discharge from a wire. Instead, a charging roller may be employed to impart electric charges to the outer circumferential surface of the photosensitive drum 21 while being driven with the outer circumferential surface thereof held in contact with the outer circumferential surface of the photosensitive drum 21.

The exposing device 23 irradiates the outer circumferential surface of the rotating photosensitive drum 21 with a laser beam modulated based on the image data electrically transmitted from an external apparatus such as a computer. Electric charges on portions of the outer circumferential surface of the photosensitive drum 21 irradiated with the laser beam are removed, thereby forming an electrostatic latent image on the outer circumferential surface of the photosensitive drum 21.

The developing device 24 attaches toner to the electrostatic latent image formed on the outer circumferential surface of the photosensitive drum 21 by supplying the toner in a developer to the outer circumferential surface of the photosensitive drum 21, whereby a toner image is formed on the outer circumferential surface of the photosensitive drum 21. It should be noted that a so-called two-component developer comprised of toner and carrier is used in the present invention. The toner is fine particles having an additive such as a colorant, a charge controlling agent or a wax dispersed in a binder resin and having a particle diameter of 6 to 12 μm. The carrier is magnetic particles of, e.g. magnetic iron ore ($Fe_3O_4$) having a particle diameter of 60 to 200 μm, and is used to charge the toner. The toner is a consumable supply suitably supplied to the developing device 24 from a toner cartridge 241, whereas the carrier of a specified amount is generally contained in the developing device 24 and cyclically used without being consumed. However, in this embodiment, the toner and the carrier (i.e., developer) are contained in the toner cartridge 241, and both the toner and the carrier are simultaneously replenished in the developing device 24.

The transfer roller 25 imparts negative electric charges having a polarity opposite to electric charges of the toner image in order to transfer the positively charged toner image formed on the outer circumferential surface of the photosensitive drum 21 to the sheet P fed to a position right below the photosensitive drum 21.

Accordingly, the sheet P fed to the position right below the photosensitive drum 21 is negatively charged while being tightly held between the transfer roller 25 and the photosensitive drum 21, whereby the positively charged toner image on the outer circumferential surface of the photosensitive drum 21 is separated by being attracted to the outer surface of the sheet P. In this way, the image transferring operation is carried out to the sheet P.

The cleaning device 26 cleans the outer circumferential surface of the photosensitive drum 21 by removing the toner residual on this outer circumferential surface after the image transferring operation to the sheet P. The outer circumferential surface of the photosensitive drum 21 cleaned by this cleaning device 26 moves toward the charger 22 again for a next image forming operation.

The fixing device 27 is for fixing the toner image transferred to the sheet P in the image transfer device 20 to the sheet P by heating. The fixing device 27 is comprised of a heating roller 271 having a conducting heat producing element such as a halogen lamp mounted therein, and a pressure roller 272 whose outer circumferential surface is opposed to the heating roller 271 below the heating roller 271. The sheet P having the image transferred thereto is fixed by obtaining heat from the heating roller 271 upon passing a nip between the heating roller 271 drivingly rotated in clockwise direction about its central axis and the pressure roller 272 driven in counterclockwise about its central axis. The sheet P having the image fixed thereto is discharged onto the discharge tray 117 through a sheet discharge path 273.

The manual feeding portion 40 as a component of the sheet feeding device 30 is provided with a fixed tray 50 whose rear edge is extended up to the upstream end of the image transfer device 20 right above the feed roller 312*a*, and a movable tray 60 connected with the upstream end of this fixed tray 50. The movable tray 60 can change the posture thereof between an accommodated posture S1 (see FIG. 5) where the movable tray 60 is accommodated in the sheet cassette 31 and a withdrawn posture S2 (see FIG. 6) where the movable tray 60 is withdrawn from the sheet cassette 31. The sheet P can be manually fed by setting the movable tray 60 in the withdrawn posture S2 with the sheet cassette 31 set at the accommodated position T1.

Figure 4:
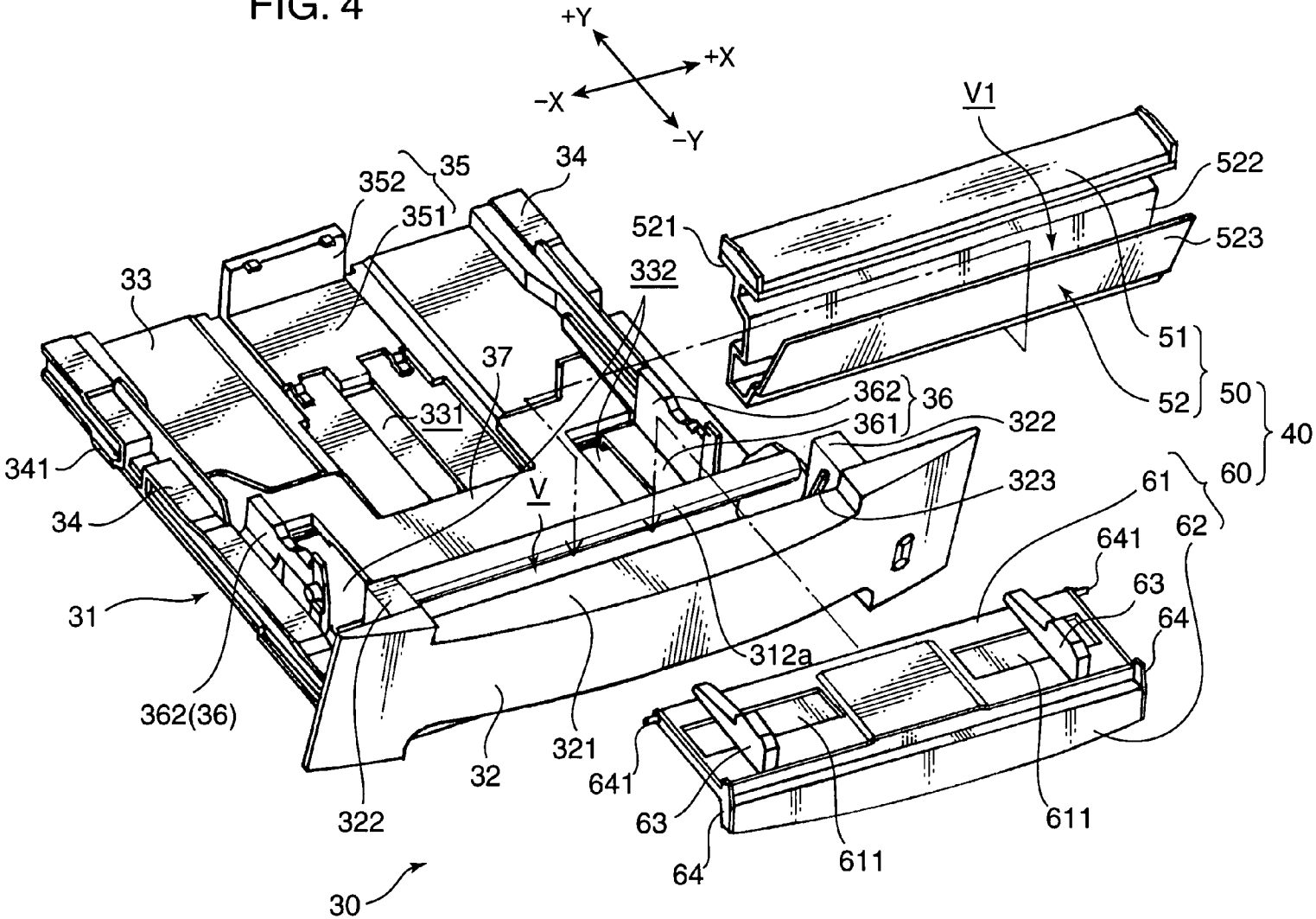
FIG. 4 is an exploded perspective view showing a first embodiment of the sheet feeding device.
Figure 5:
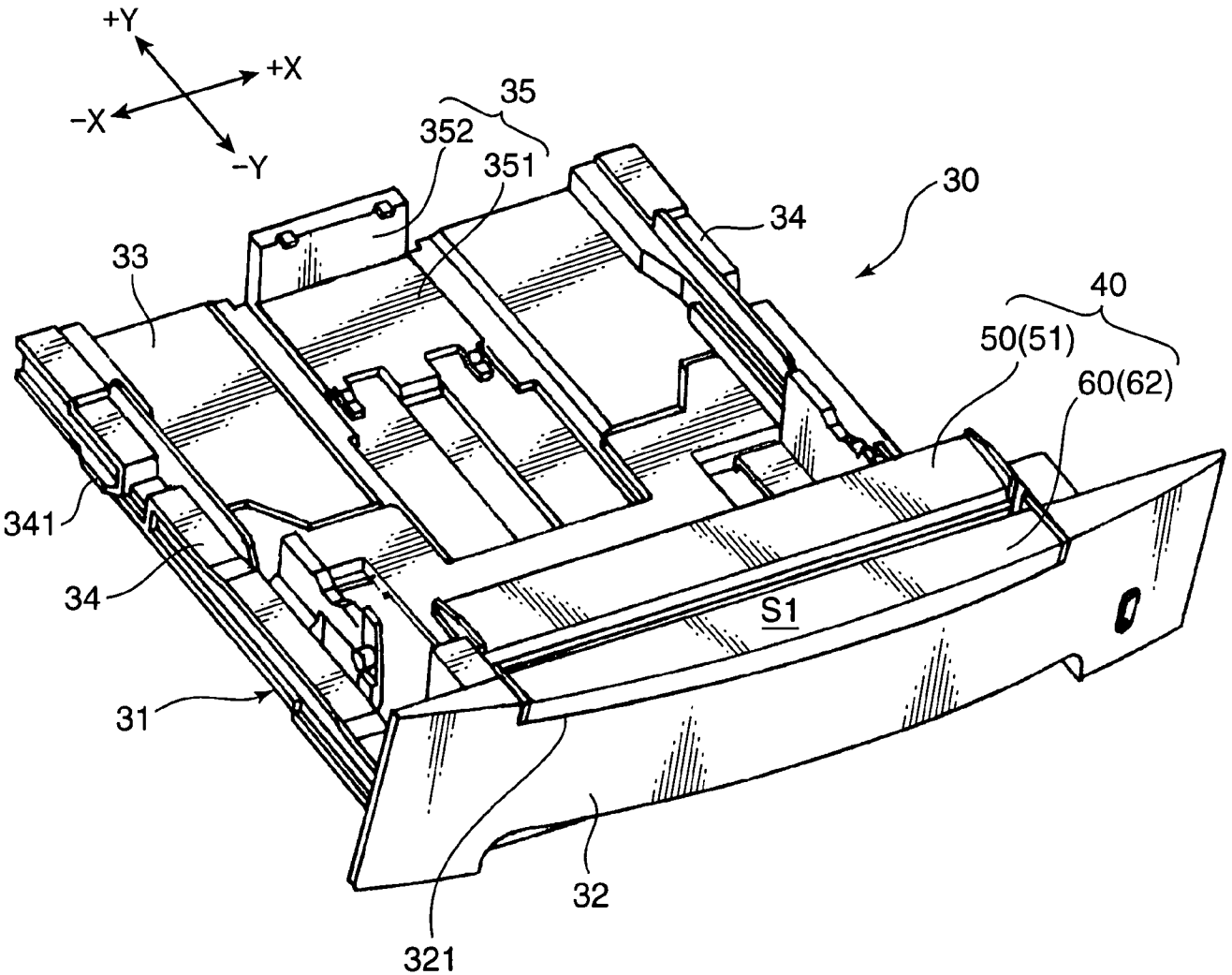
FIG. 5 is a perspective view showing the assembled sheet feeding device shown in FIG. 4 with the movable tray of the manual feeding portion set in the accommodated posture.
Figure 6:
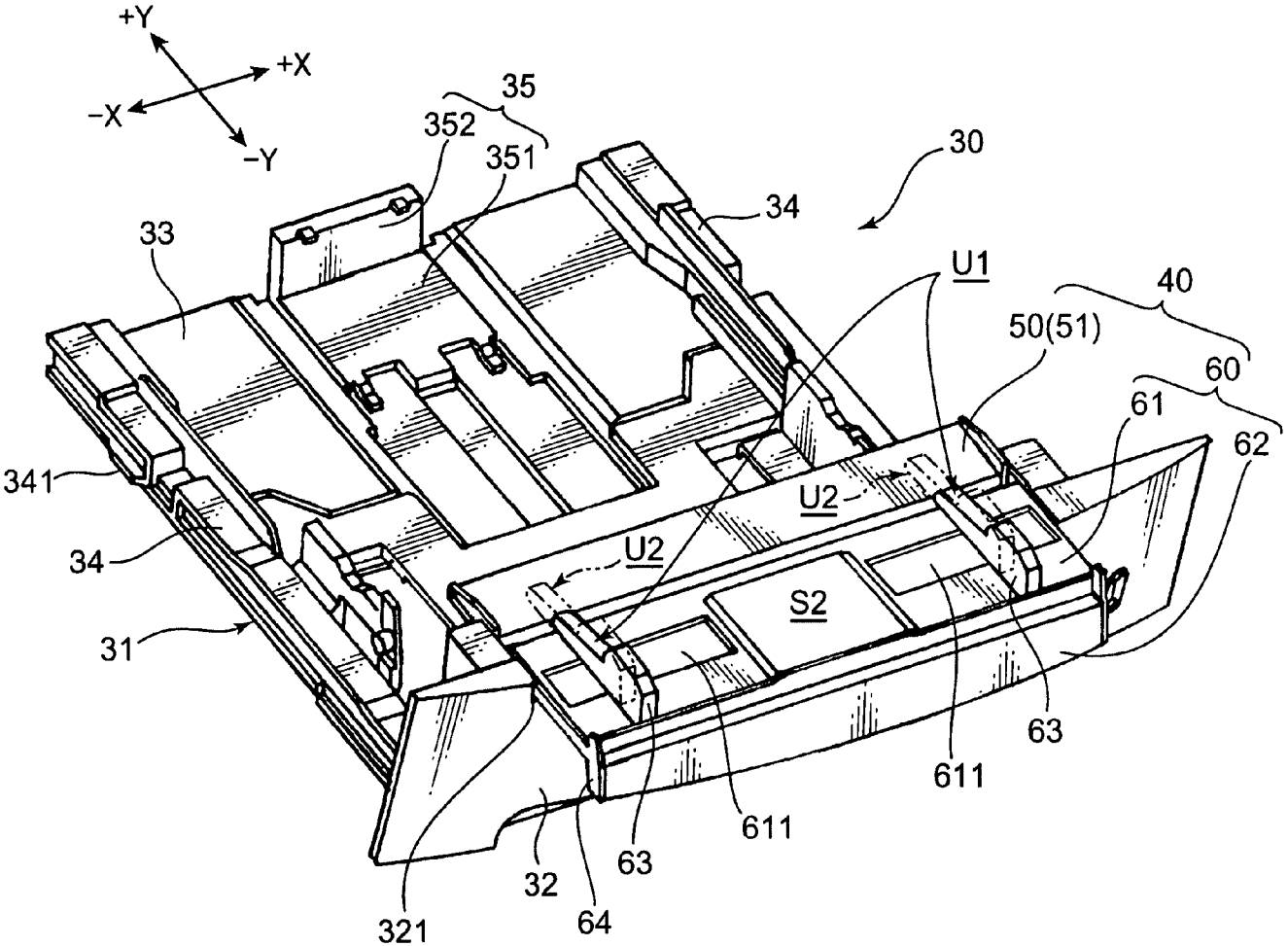
FIG. 6 is a perspective view showing the assembled sheet feeding device shown in FIG. 4 with the movable tray of the manual feeding portion set in the withdrawn posture and with cursors set at normal positions.

Such a sheet feeding device 30 is described in detail with reference to FIGS. 4 to 6 below. FIG. 4 is an exploded perspective view showing a first embodiment of the sheet feeding device 30. FIGS. 5 and 6 are perspective views showing the assembled sheet feeding device 30 shown in FIG. 4, wherein FIG. 5 shows a state where the movable tray 60 of the manual feeding portion 40 is set in the accommodated posture S1 and FIG. 6 shows a state where the movable tray 60 of the manual feeding portion 40 is set in the withdrawn posture S2. Particularly in FIG. 6, a state where cursors 63 are set at normal positions U1 is shown in solid line and a state reached by sliding the cursors 63 to downstream positions U2 is shown in chain double-dashed line. Directions shown by X and Y in FIGS. 4 to 6 are the same as in the case of FIG. 1 (transverse directions X (−X: leftward, +X: rightward), forward and backward directions Y (−Y: forward, +Y: backward)).

First, with reference to FIG. 4, the sheet cassette 31 in which the manual feeding portion 40 is mounted is described before describing the manual feeding portion 40. The sheet cassette 31 is provided with the arched front plate 32 whose front surface arcuately bulges outward (forward), a bottom plate 33 extending backward from the bottom edge of the backside (rear surface) of this arched front plate 32, and a pair of side plates 34 projecting upward from the opposite left and right sides of this bottom plate 33 and extending in forward and backward directions.

Guidable projecting pieces 341 projecting in opposite directions are provided at a specified position of each side plate 34. On the other hand, the pair of side plates 111 (see FIG. 3) of the apparatus main body 11 are recessed to form guide grooves 111*a* corresponding to the guidance projecting pieces 341 and extending in forward and backward directions. The sheet cassette 31 is displaceable between the accommodated position T1 (see FIG. 2) where the sheet cassette is accommodated in the apparatus main body 11 and the withdrawn position T2 (see FIG. 3) where the sheet cassette 31 projects out from the apparatus main body 11 by being moved in forward and reverse directions while the respective guidable projecting pieces 341 are guided by these guide grooves 111*a*.

The bottom plate 33 is provided with a forward/backward movement guiding recess 331 formed at a transverse middle position of the upper surface thereof and extending in forward and backward directions, and a front/rear position restricting member 35 movable forward and backward while being guided by the forward/backward movement guiding recess 331. The front/rear position restricting member 35 is for restricting the front end position of the sheet bunch P1 (see FIG. 1) placed on the bottom plate 33, and comprised of a horizontal plate 351 slidable in the forward/backward movement guiding recess 331 and a vertical plate 352 standing from the rear end of the horizontal plate 351. The vertical plate 352 can be brought into contact with the rear end of the sheet bunch P1 by being moved in conformity with the sheet size.

The bottom plate 33 is also provided with a pair of leftward/rightward movement guiding recesses 332 facing each other along transverse directions at front positions of the upper surface of the bottom plate 33, and a pair of left/right position restricting members 36 movable along transverse directions while being guided by the leftward/rightward movement guiding recesses 332. These left/right position restricting members 36 are for restricting the left and right positions of the sheet bunch P1 (see FIG. 1) placed on the bottom plate 33, and are each comprised of a horizontal plate 361 slidable in the leftward/rightward movement guiding recess 332 and a vertical plate 362 standing from the lateral edge of the horizontal plate 361 distant from the other horizontal plate 361. The sheet bunch P1 can be tightly held by the pair of vertical plates 362 by moving these left/right position restricting members 36 by the same amount in conformity with the sheet size.

Accordingly, the sheet bunch P1 placed on the bottom plate 33 of the sheet cassette 31 is positioned in the sheet cassette 31 by being tightly held by the front/rear position restricting member 35 and the pair of left/right position restricting members 36.

A biasing plate 37 for biasing the front half of the sheet bunch P1 placed without interfering with the left/right position restricting member 36 upward is provided at a front-half position of the bottom plate 33. This biasing plate 37 has the rear end thereof supported rotatably about a supporting shaft 371 (see FIG. 2) extending in transverse directions, and is biased upward by a coil spring 372 (see FIG. 2). By this biasing, the uppermost sheet P of the sheet bunch P1 contained in the sheet cassette 31 is held in contact with the feed roller 311 with the sheet cassette 31 accommodated in the apparatus main body 11. Accordingly, the uppermost sheets P of the sheet bunch P1 are successively fed toward the image transfer device 20 via the feed roller 311, the conveying rollers 312, 312*a* and the sheet conveyance path 313 by drivingly rotating the feed roller 311.

The manual feeding portion 40 comprised of the fixed tray 50 and the movable tray 60 is formed at a front position of such a sheet cassette 31. For the attachment of the manual feeding portion 40 to the sheet cassette 31, an upper part of the arched front plate 32 is recessed in its transverse middle portion to form the recessed groove 321 for receiving the movable tray 60. Further, a pair of left and right side walls 322 are provided on the backside (rear surface) of the arched front plate 32. A mounting space V used to mount the fixed tray 50 is defined in a section enclosed by the pair of side walls 322, the arched front plate 32 and the feed roller 311.

The fixed tray 50 is for guiding a sheet P being manually fed by means of the movable tray 60 to the sheet conveyance path 313 (see FIG. 2), and includes a tray main body 51 elongated in transverse directions, and a tray supporting member 52 for supporting this tray main body 51. The tray main body 51 has a transverse dimension thereof set to be substantially equal to that of the recessed groove 321 of the arched front plate 32 while having a width thereof in forward and backward directions set to be substantially equal to that of the mounting space V. The fixed tray 50 covers the feed roller 311 and the conveying roller 312 disposed behind the mounting space V while being mounted in the mounting space V.

The tray supporting member 52 is comprised of a tray supporting plate 521 whose planar shape is set to be identical to that of the tray main body 51, a rear plate 522 projecting downward from a substantially middle part of the tray supporting plate 521 with respect to forward and backward directions and extending in transverse directions, and a front plate 523 extending upward from the bottom edge of the rear plate 522. The tray main body 51 is closely fixed to the tray supporting plate 521.

The rear plate 522 and the front plate 523 are so shaped as to be insertable into the mounting space V from above in consideration of the positional relationship with the feed roller 311, the conveying roller 312 and the like. These rear plate 522 and front plate 523 are inserted and fixed in the mounting space V, whereby the fixed tray 50 is mounted at a specified position of the sheet cassette 31 as shown in FIGS. 5 and 6. An accommodation space V1 for accommodating the movable tray 60 set in the accommodated posture S1 is defined between the rear plate 522 and the front plate 523.

The movable tray 60 includes a manual feed tray 61 for, guiding a sheet P being manually inserted with the movable tray 60 set in the withdrawn posture S2 (see FIG. 6), a lid 62 for closing the recessed groove 321 formed in the arched front plate 32 of the sheet cassette 31 with the movable tray 60 set in the accommodated posture S1 (see FIG. 5), and a pair of left and right cursors 63 provided on the manual feed tray 61. The lid 62 is connected with the manual feed tray 61 in a bent-down state in FIG. 4 at the front edge of the manual feed tray 61.

The manual feed tray 61 has a transverse dimension thereof set to be slightly shorter than that of the recessed groove 321 formed in the arched front-plate 32 of the sheet cassette 31 while having a width thereof in forward and backward directions set to be considerably longer (about threefold in this embodiment) than that of the recessed groove 321. By such dimensioning, the manual feed tray 61 projects forward a considerable distance from the arched front plate 32 of the sheet cassette 31 as shown in FIGS. 1B and 6 with the movable tray 60 set in the withdrawn posture S2.

On the contrary, the lid 62 has a transverse dimension thereof set to be equal to that of the manual feed tray 61 and has a width thereof in forward and backward directions set to be equal to that of the recessed groove 321 over the entire length (i.e. the front part thereof has the same planar shape as the recessed groove 321). By such dimensioning, the lid 62 is fitted in the recessed groove 321 as shown in FIGS. 1A and 5 with the manual feed tray 61 accommodated in the accommodation space V1 by setting the movable tray 60 in the accommodated posture S1. Therefore, the lid 62 does not project forward from the arched front plate 32 of the sheet cassette 31 while closing the recessed groove 321. Incidentally, structural strength is ensured for the movable tray 60 by fixing T-shaped reinforcing members 64 to the opposite ends of the manual feed tray 61 and the lid 62.

In this embodiment constructed as above, no sheet P can be manually fed with the movable tray 60 set in the accommodated posture S1 (see FIG. 5) since the upstream end of the fixed tray 50 is closed. On the other hand, if the movable tray 60 is set in the withdrawn posture S2 (see FIG. 2), a sheet P can be manually fed via the manual feed tray 61.

The respective cursors 63 can be respectively reciprocated along also the width direction of the sheet while being guided by a pair of guiding oblong holes (guiding portions) 611 formed in the manual feed tray 61 and extending in transverse directions. A wide width is set in forward and backward directions for the guiding oblong holes 611 so that the respective cursors 63 can also be moved in opposite directions along a sheet conveyance direction.

By being guided by such guiding oblong holes 611, the pair of cursors 63 can be moved along transverse directions while a spacing between the inner sides thereof is set in conformity with the width of the sheet P to be manually fed. Further, the pair of cursors 63 are movable in forward and backward directions in conformity with the length of the sheet P in the sheet conveyance direction. In other words, the rear end positions of the cursors 63 with respect to the sheet conveyance direction can be shifted along the sheet conveyance direction.

The pair of guiding oblong holes 611 are transversely symmetrically formed in the manual feed tray 61 while being slightly displaced from each other in forward and backward directions. A minimum spacing between the guiding oblong holes 611 is set to be substantially equal to the lateral dimension (shorter dimension) of a sheet P of postcard size, whereas a maximum distance therebetween is set to be substantially equal to the longitudinal dimension of a sheet P of A4 size (longer dimension, the same as the lateral dimensions of a sheet P of the A3 size). Accordingly, the distance between the pair of cursors 63 can be adjusted for variously sized sheets from smallest sheets P of postcard size to largest sheets P of A3 size.

Guidable shafts 641 project in opposite directions at rear end positions of the respective reinforcing members 64 in FIG. 4. Further, the pair of side walls 322 provided on the backside of the arched front plate 32 are formed with guiding grooves 323 facing each other and vertically extending. The respective guidable shafts 641 are fitted into the corresponding guiding grooves 323. Accordingly, the movable tray 60 can change the posture thereof between the accommodated posture S1 (see FIG. 5) where the manual feed tray 61 is accommodated in the accommodation space V1 and the withdrawn posture S2 (see FIG. 6) where the manual feed tray 61 is withdrawn from the accommodation space V1 to become in flush with the tray main body 51 of the fixed tray 50 while the respective guidable shafts 641 are guided by the corresponding guiding grooves 323.

Figure 7:
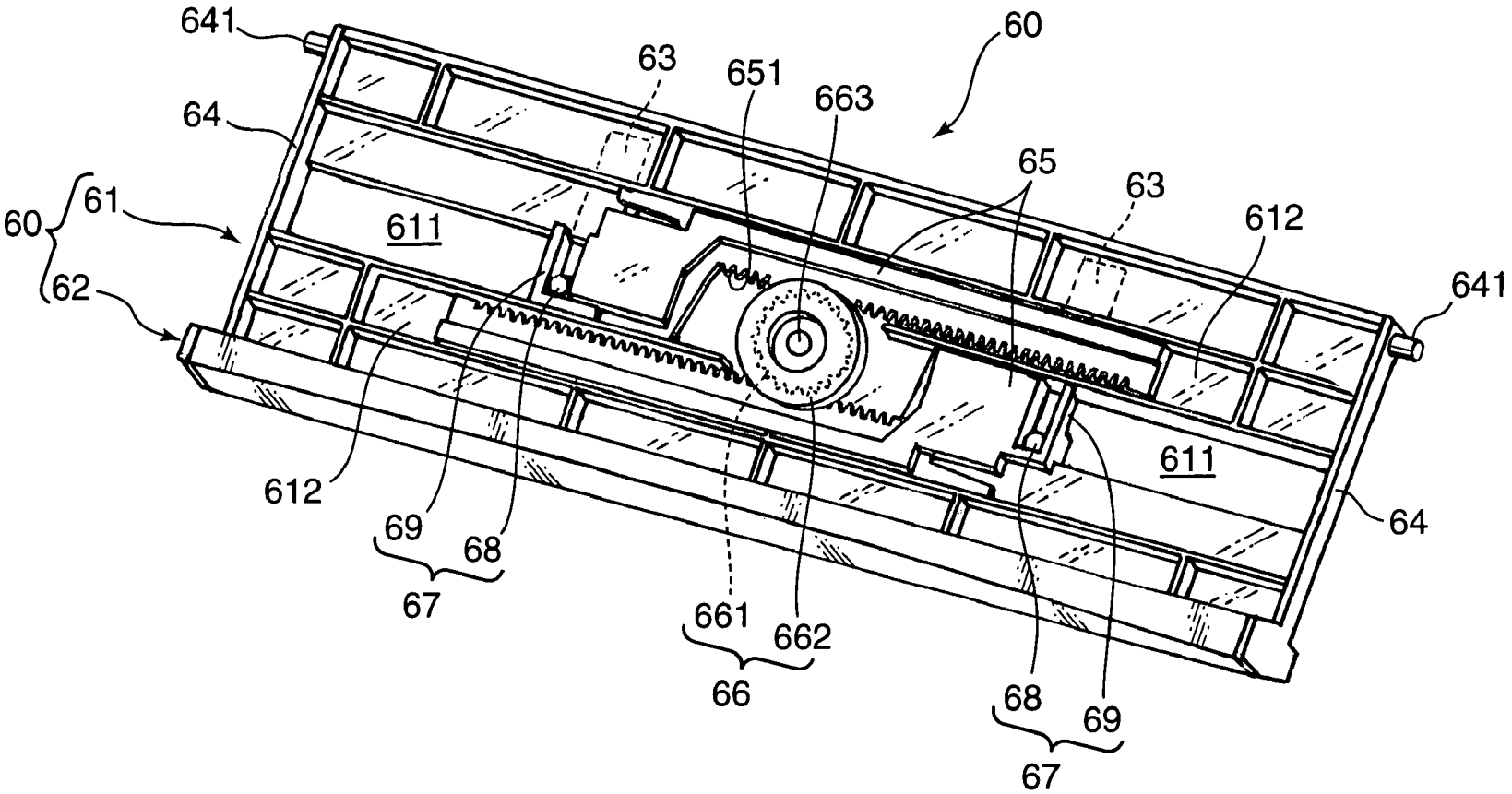
FIG. 7 is a perspective view of the movable tray from below showing one embodiment of an interlocking structure for a pair of cursors.

FIG. 7 is a perspective view of the movable tray 60 from below showing one embodiment of an interlocking structure for the pair of cursors 63. As shown in FIG. 7, a pair of cursor supporting members 65 movable along transverse directions while being guided by the pair of left and right guiding oblong holes 611 are provided on the underside of the manual feed tray 61. These cursor supporting members 65 are for detachably supporting the corresponding cursors 63 and have rack teeth 651 provided on the facing end surfaces thereof, wherein the respective rack teeth 651 are connected with each other via a pinion member 66 engaged therewith. The pinion member 66 is disposed substantially in the center of the manual feed tray 61.

Guiding recessed grooves 612 for guiding movements of the respective cursor supporting members 65 are provided at the underside of the manual feed tray 61. The respective cursor supporting members 65 are guided by the corresponding guiding recessed grooves 612, thereby being smoothly moved in transverse directions.

The pinion member 66 is comprised of a pinion main body 661 in mesh with the respective rack teeth 651 of the pair of cursor supporting members 65 facing each other, and a flange 662 formed to be concentric with and integral to the pinion main body 661. The diameter of the flange 662 is set to be slightly larger than that of the pinion main body 661. The pinion member 66 is supported rotatably about a central axis 663 at the center position of the manual feed tray 61. By the presence of the flange 662, the detachment of the respective cursor supporting members 65 in mesh with the pinion main body 661 is prevented.

According to such an interlocking structure for the cursors 63, if one cursor 63 is moved along the guiding oblong hole 611, a moving force thereof is transmitted to the pinion main body 661 via the rack teeth 651 of the one cursor supporting member 65, thereby rotating the pinion member 66 about the central axis 663. This rotation is transmitted to the other cursor supporting member 65 via the rack teeth 651 of the other cursor supporting member 65. Thus, the other cursor supporting member 65 is moved in an opposite direction by the same distance as the one cursor supporting member 65. As a result, the other cursor 63 is also moved by operating only the one cursor 63.

Figure 8:
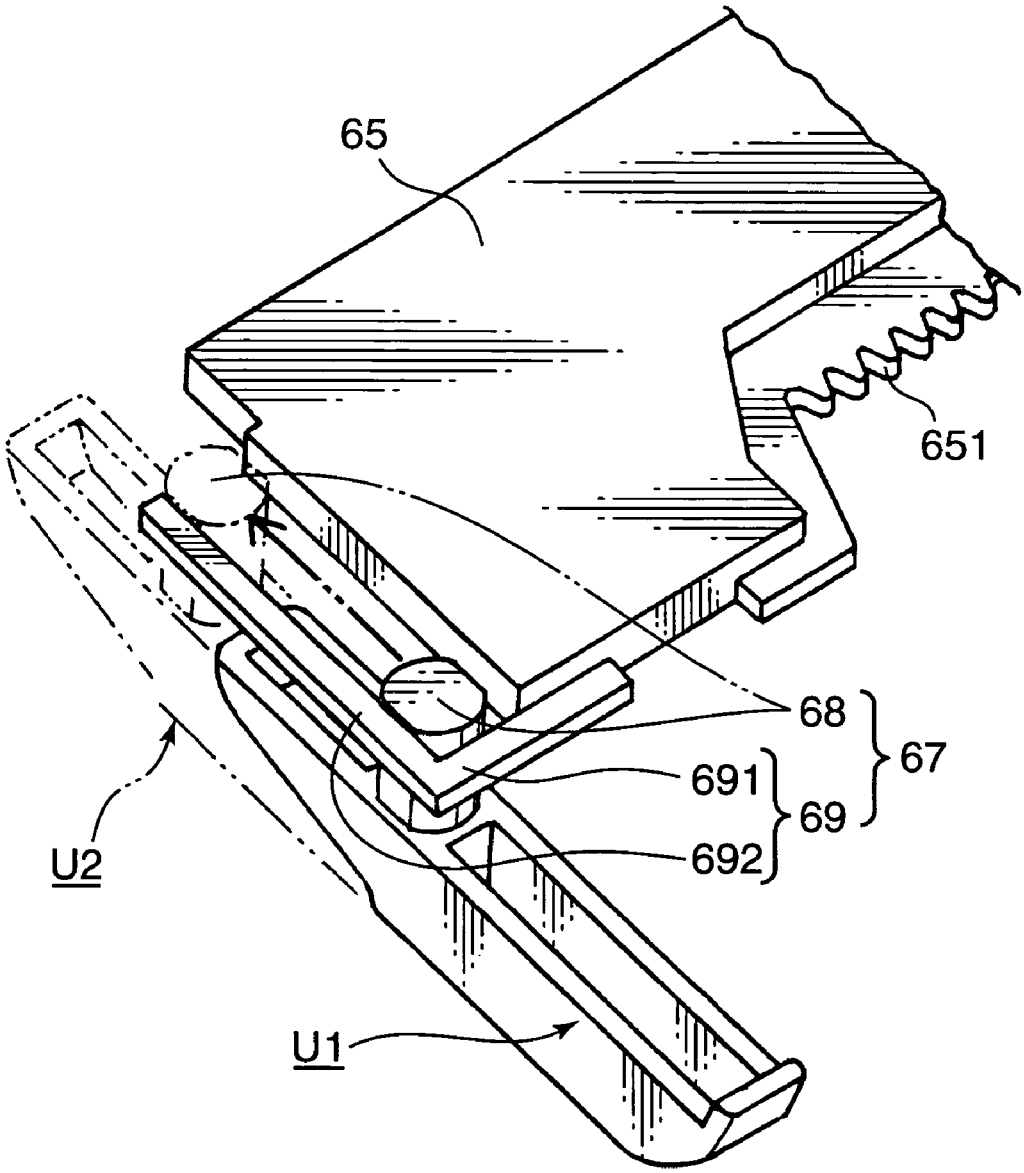
FIG. 8 is an enlarged perspective view from below showing one embodiment of a detaching structure for the cursors.

The pair of cursors 63 are movably held onto such cursor supporting members 65 by holding structures 67. FIG. 8 is an enlarge perspective view from below showing one embodiment of the holding structure 67 for the cursor 63, wherein the shown holding structure 67 is the left one in FIG. 7. The holding structures 67 are provided to make the cursors 63 movable in forward and backward directions while the detachment thereof from the cursor supporting members 65 is prevented regardless of at which positions in the guiding oblong holes 611 (see FIG. 7) the cursor supporting members 65 are located. Each holding structure 67 is comprised of a column-shaped projection 68 projecting from a substantially longitudinal middle position of the underside (upper surface in FIG. 8) of the cursor 63, and a hook-shaped locking piece 69 provided at an end of the cursor supporting member 65 to enfold the column-shaped projection 68.

The column-shaped projection 68 is set to have an oval planar shape in this embodiment. However, the planar shape thereof is not limited to such an oval shape, and the projection 68 may be in the form of a cylinder or a prism.

The hook-shaped projecting piece 69 is comprised of a prism-shaped first projecting piece 691 projecting in an extending direction of the rack teeth 651 from an end surface at a side of the end of the cursor supporting member 65 where the rack teeth 651 are provided and a prism-shaped second projecting piece 692 extending backward at right angle from the leading end of the first projecting piece 691. A clearance between the second projecting piece 692 and the end edge of the cursor supporting member 65 is set to be slightly smaller than a dimension in the planar shape of the column-shaped projection 68 corresponding to this clearance. The hook-shaped projecting piece 69 is elastically deformed when the column-shaped projection 68 is inserted into this clearance. A locked state of the column-shaped projection 68 by the hood-shaped locking piece 69 is stabilized by an elastic force acting at this time.

A longitudinal dimension of the second projecting piece 692 is set to be substantially the same as the transverse dimension of the guiding oblong holes 611. Accordingly, even if the cursor 63 is positionally changed between the normal position U1 and the downstream position U2, the column-shaped projection 68 will not go out of the clearance between the second projecting piece 692 and the end edge of the cursor supporting member 65.

The column-shaped projection 68 is freed from the locked state by the hook-shaped locking piece 69 against the elastic force of the hook-shaped locking piece 69 by pushing the cursor 63 in a direction of arrow shown in chain double-dashed line in FIG. 8 with a specified force. On the other hand, the column-shaped projection 68 is locked between the second projecting piece 692 and the cursor supporting member 65 by the elastic deformation of the hook-shaped locking piece 69 by moving the cursor 63 in an opposite direction.

Figure 9A:
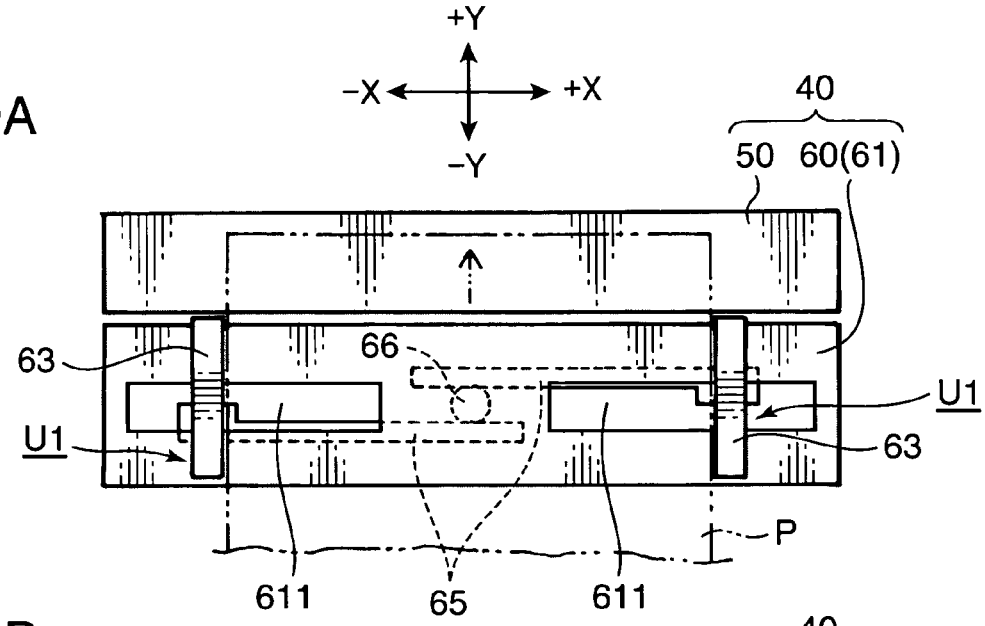
Figure 9B:
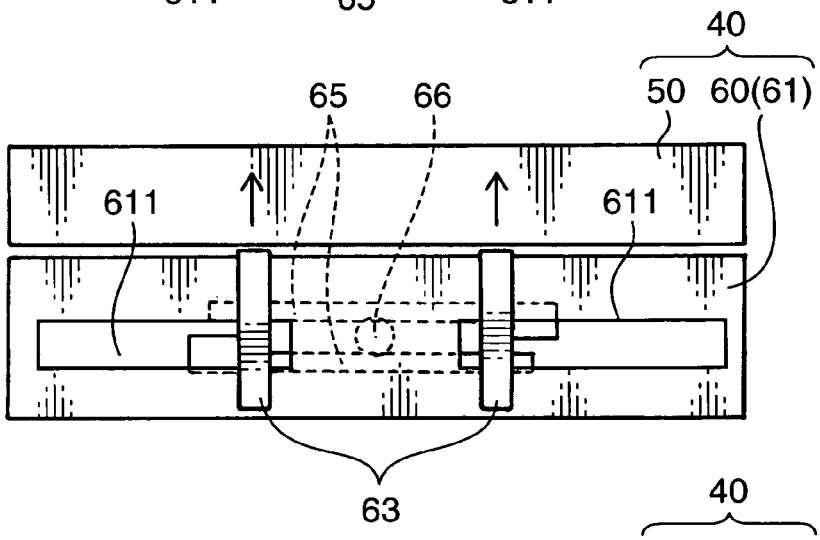
Figure 9C:
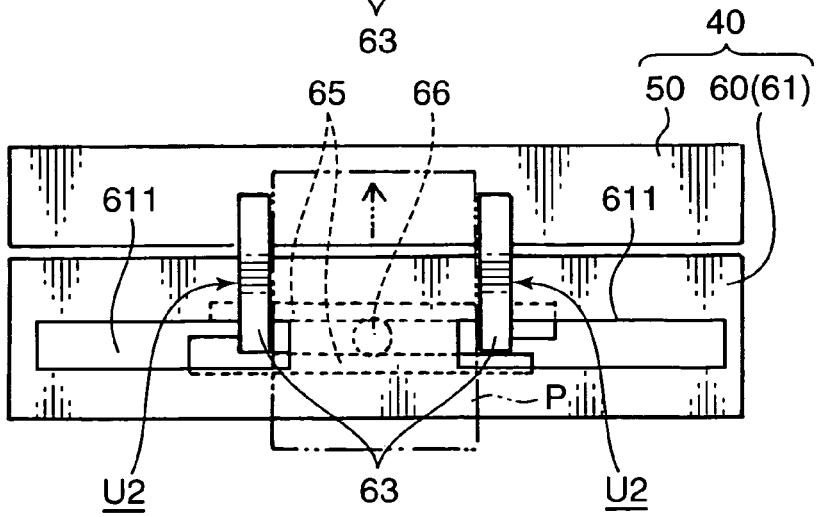

Hereinafter, functions of the manual feeding portion 40 according to the first embodiment are described with reference to FIGS. 9A to 9C and also to FIGS. 1 to 8 if necessary. FIGS. 9A to 9C are plan views of the manual feed tray 61 showing functions of the manual feeding portion 40 according to the first embodiment, wherein FIG. 9A shows a state where the pair of cursors 63 are set at normal positions, FIG. 9B shows a state reached by moving the pair of cursors 63 to positions having a minimum spacing therebetween, and FIG. 9C shows a state where the pair of cursors 63 are set at downstream positions. Directions shown by X and Y in FIGS. 9A to 9C are the same as in the case of FIG. 1 (transverse directions X (−X: leftward, +X: rightward), forward and backward directions Y (−Y: forward, +Y: backward)).

First, in the state shown in FIG. 9A, the pair of cursors 63 lockingly engaged with the respective cursor supporting members 65 by the hook-shaped locking pieces 69 (see FIG. 8) are set at positions in the guiding oblong holes 61 via the cursor supporting members 65 where a standard sheet P of, e.g. A4 size can be manually fed straight. Although the respective cursors 63 are set at the normal positions U1 at this time, since the sheet P is of, e.g. A4 size, the sheet P can be properly manually fed while being guided by the pair of cursors 63 even if the cursors 63 are not particularly displaced to the downstream positions U2.

Upon manually feeding a small-size sheet P such as a postcard, one cursor 63 may be moved along the guiding oblong hole 611 in conformity with the width of the sheet P. Then, the other cursor 63 is moved in an opposite direction by the same distance by way of the pinion member 66, whereby a spacing between the pair of cursors 63 comes to conform to the sheet P of the smaller size. It should be noted that the rear end positions of the cursors 63 are not yet shifted in the sheet conveyance direction in this state.

The column-shaped projections 68 (see FIG. 8) of the cursors 63 are moved into the apparatus main body 11 while being guided along the clearances between the second projecting pieces 692 and the end edges of the cursor supporting members 65 by pushing the respective cursors 63 into the apparatus main body 11 as shown in arrows in FIG. 9B. As a result, the cursors 63 are set at the downstream positions U2 shown in FIG. 9C. In other words, the rear end position of the cursors 63 are shifted in the sheet conveyance direction.

With the respective cursors 63 set at the downstream positions U2, the downstream ends of the respective cursors 63 are located substantially in the middle part of the fixed tray 50. Accordingly, upon manually feeding the small-size sheet P, this sheet P has the opposite lateral sides thereof guided by the pair of cursors 63 located in the vicinity of the sheet conveyance path 313 (see FIG. 2). Therefore, the small-size sheet P can be fed straight to the registration roller pair 314 (see FIG. 2) without being laterally or obliquely displaced.

As described in detail above, the sheet feeding device 30 according to the first embodiment includes the manual feeding portion 40 used to manually feed a sheet P into the apparatus main body 11 of the printer 10. This manual feeding portion 40 is provided with the manual feed tray 61 for guiding a sheet P being manually fed and the pair of cursors 63 provided on this manual feed tray 61 and movable in opposite directions along the sheet width direction normal to the sheet conveyance direction in conformity with the width of the sheet P. The pair of cursors 63 are constructed to be movable into the apparatus main body 11.

With such a construction, upon manually feeding a sheet P into the apparatus main body 11 of the printer 10 by way of the manual feeding portion 40, the sheet P can be fed straight without being displaced along width direction by adjusting the spacing between the pair of cursors 63 in conformity with the width of the sheet P beforehand.

The pair of cursors 63 approach a sheet conveying position (registration roller pair 314) in the apparatus main body 11 by moving the respective cursors 63 into the apparatus main body 11 in conformity with the length of the sheet P along the sheet conveyance direction. Thus, small-size sheets P can be fed straight into the apparatus main body 11 without being laterally displaced.

By constructing the pair of cursors 63 provided on the manual feed tray 61 to be movable toward the inside of the apparatus main body 11 in this way, the sheet P can be manually fed along the cursors 63 regardless of the size thereof. Accordingly, unlike the prior art, an occurrence of such an inconvenience that the sheet P cannot be fed straight by assuming an oblique posture because the cursors 63 do not extend up to the inside of the apparatus main body 11 can be securely prevented upon manually feeding the small-size sheet P.

Further, the manual feed tray 61 is formed with the pair of guiding oblong holes 611 for guiding movements of the pair of cursors 63. Thus, the respective cursors 63 can be stably moved along the sheet width direction while being guided by the corresponding guiding oblong holes 611.

Furthermore, there are provided the cursor supporting members 65 movable by being guided by the guiding oblong holes 611 while supporting the cursors 63, and the cursors 63 are constructed to be movable along the sheet conveyance direction with the positions thereof set to have a specified spacing therebetween while being supported by the cursor supporting members 65. Therefore, the cursors 63 can be freely moved in a fairly stable state in both the sheet width direction and the sheet conveyance direction.

Second Embodiment

Figure 10:
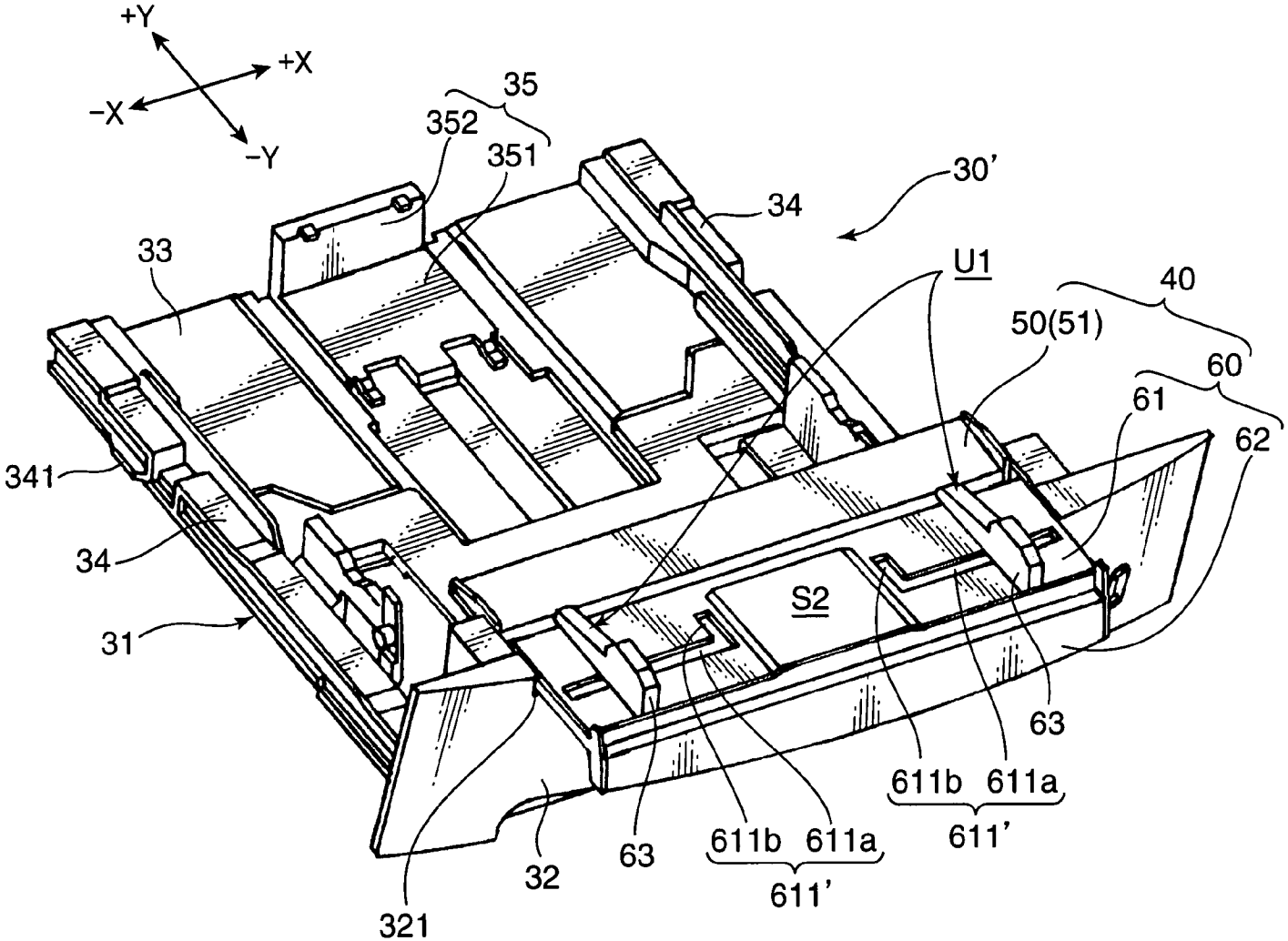
FIG. 10 is a perspective view of a second embodiment of a sheet feeding device showing a state where a pair of cursors are set at normal positions.
Figure 11:
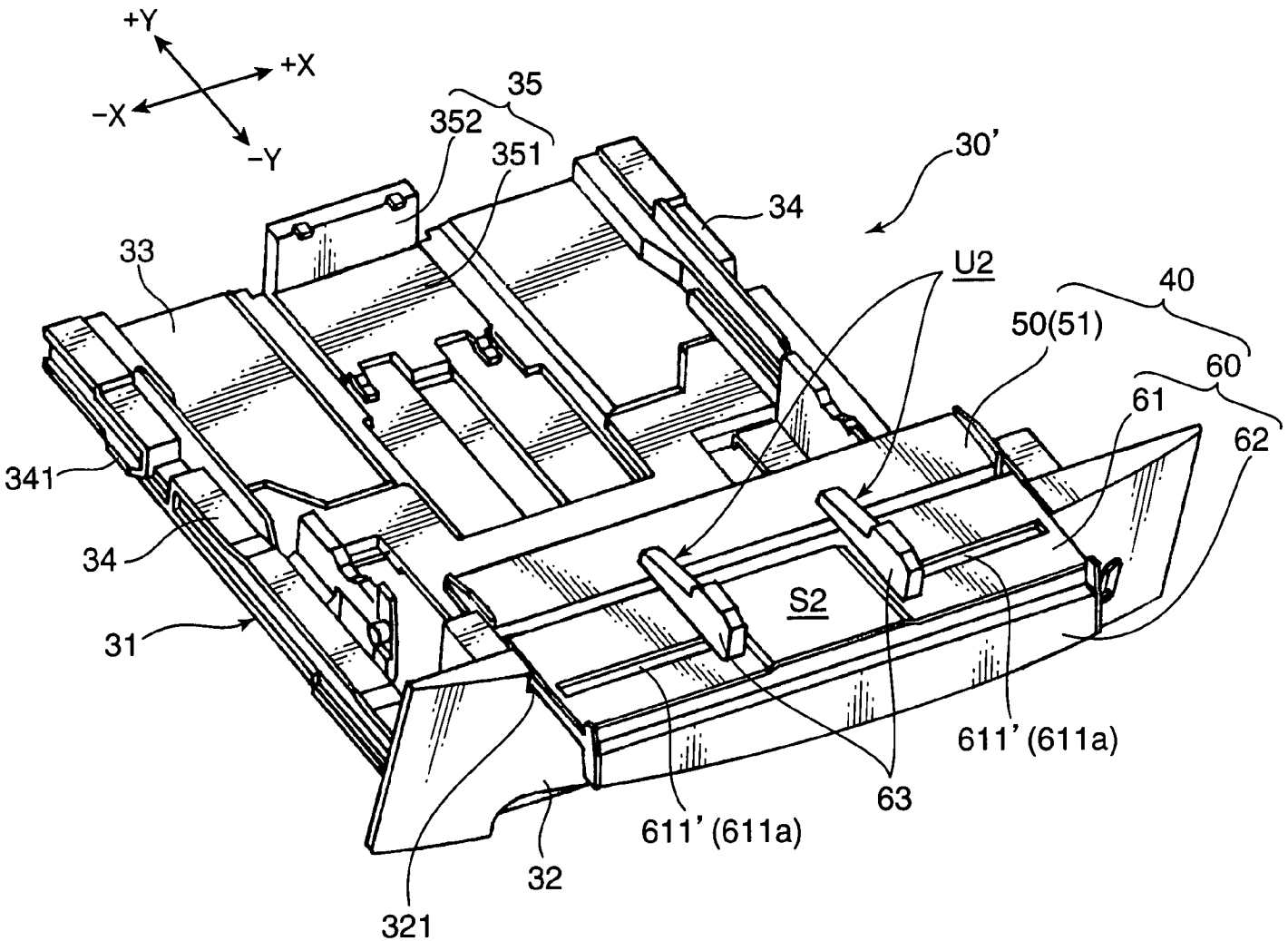
FIG. 11 is an exploded perspective view of the second embodiment of the sheet feeding device showing a state reach by moving the pair of cursors to downstream positions having a minimum spacing therebetween.

A sheet feeding device according to a second embodiment is the one according to a modification of the first embodiment. Parts identical or common to those of the first embodiment are not described in order to avoid repetition. FIGS. 10 and 11 are perspective views showing a sheet feeding device 30' according to the second embodiment, wherein FIG. 10 shows a state where a pair of cursors 63 are set at normal positions U1 and FIG. 11 shows a state reached by moving the pair of cursors 63 to downstream positions U2 having a minimum spacing therebetween. Directions shown by X and Y in FIGS. 10 and 11 are the same as in the case of FIG. 1 (transverse directions X (−X: leftward, +X: rightward), forward and backward directions Y (−Y: forward, +Y: backward)).

The sheet feeding device 30' of this embodiment was designed to particularly enable the smooth manual feed of a sheet P of postcard size. Each guiding oblong hole 611' formed in a manual feed tray 61 is comprised of a widthwise movement guide 611*a* extending in transverse direction and a forward/backward movement guide 611*b* extending backward from a position of the guide 611*a* closest to the other guide 611*a*.

The forward/backward movement guides 611*b* guide movements of the cursors 63 toward the inside of an apparatus main body 11 with the cursors 63 set to have a minimum spacing (distance in conformity with a sheet of the postcard size).

Since the guiding oblong holes 611' are formed as above, the cursors 63 cannot be moved backward to the downstream positions U2 for a sheet P having a size larger than the postcard size in the sheet feeding device 30'. In other words, when the spacing between the pair of cursors 63 exceeds the minimum spacing, the respective cursors 63 are set at the normal positions U1 as shown in FIG. 10. On the other hand, if the spacing between the pair of cursors 63 is set to the minimum spacing, the respective cursors 63 can be displaced from the normal positions U1 to the downstream positions U2 as shown in FIG. 11 by being pushed backward.

Figure 12:
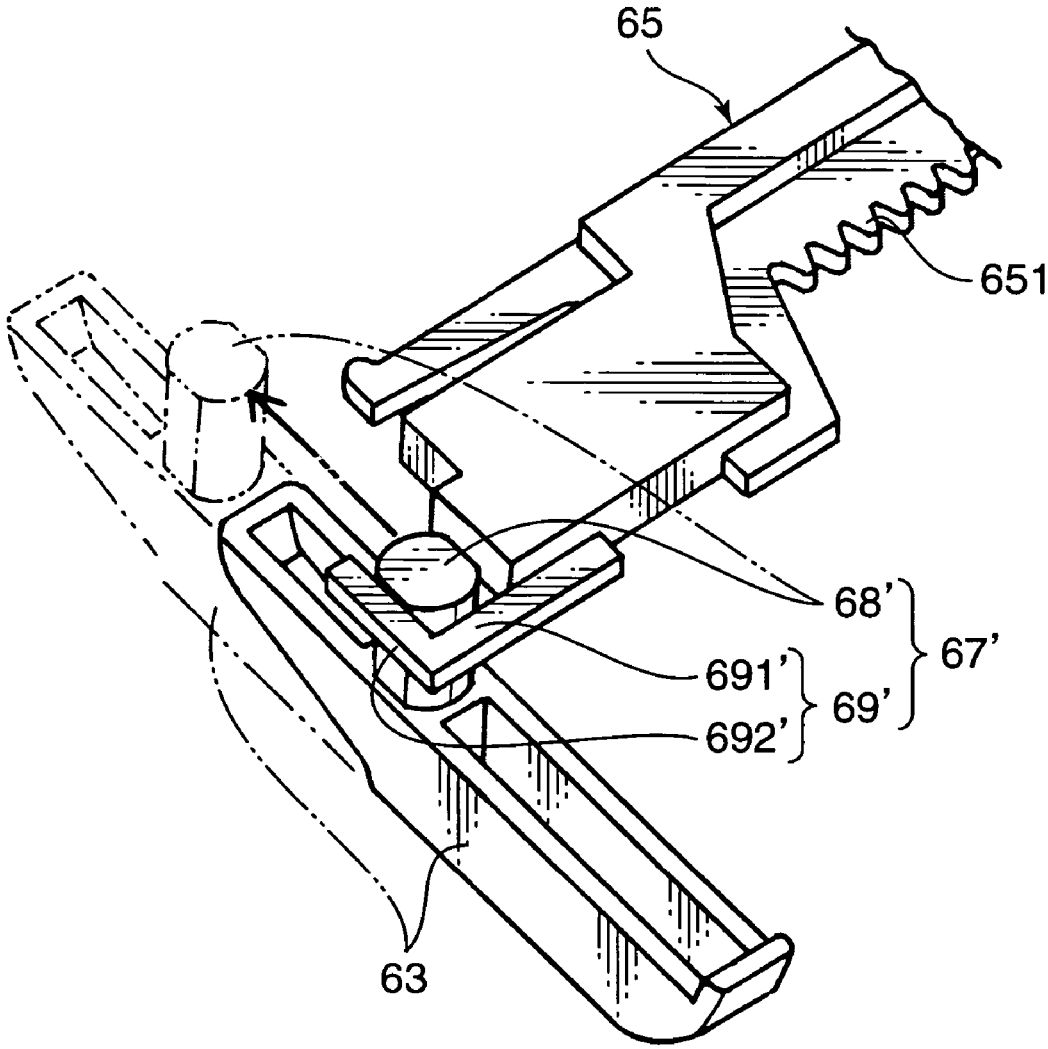
FIG. 12 is a perspective view showing one embodiment of a holding structure employed in the sheet feeding device according to the second embodiment.

FIG. 12 is a perspective view showing one embodiment of a holding structure 67' employed in the sheet feeding device 30' of the second embodiment. This holding structure 67' enables the cursor 63 to move along the forward/backward movement guide 611*b* by freeing the cursor 63 from the locked state by a cursor supporting member 65 when a spacing between the pair of cursor supporting members 65 is a minimum spacing (see FIG. 7). Each holding structure 67' is comprised of a column-shaped projection 68' projecting from a substantially longitudinal middle position of the underside (upper surface in FIG. 12) of the cursor 63, and a hook-shaped locking piece 69' provided at an end of the cursor supporting member 65 to enfold the column-shaped projection 68'.

The column-shaped projection 68' is set to have an oval planar shape in this embodiment. However, the planar shape thereof is not limited to such an oval shape, and the projection 68' may be in the form of a cylinder or a prism.

The hook-shaped projecting piece 69' is comprised of a prism-shaped first projecting piece 691' projecting from an end surface at a side of the end of the cursor supporting member 65 where the rack teeth 651 are provided in an extending direction of the rack teeth 651 and a prism-shaped second projecting piece 692' extending backward at right angle from the leading end of the first projecting piece 691'. A clearance between the second projecting piece 692' and the end edge of the cursor supporting member 65 is set to be slightly smaller than a dimension in the planar shape of the column-shaped projection 68' corresponding to this clearance. The hook-shaped projecting piece 69' is elastically deformed when the column-shaped projection 68' is inserted into this clearance. A locked state of the column-shaped projection 68' by the hood-shaped locking piece 69' is stabilized by an elastic force acting at this time.

The length of the second projecting piece 692' is set such that the column-shaped projection 68' is disengaged from the hook-shaped locking piece 69' against the elastic force of the hook-shaped locking piece 69' by pushing the cursor 63 in a direction of arrow shown in chain double-dashed line in FIG. 12 with a specified force. If the cursor 63 is moved in an opposite direction with the column-shaped projection 68' temporarily disengaged from the second projecting piece 692', the column-shaped projection 68' is inserted again into the clearance between the second projecting piece 692' and the end surface of the cursor supporting member 65. The column-shaped projection 68' is locked by the elastic force of the hook-shaped locking piece 69'.

The other construction of the sheet feeding device 30' of the second embodiment is basically similar to that of the first embodiment.

Figure 13A:
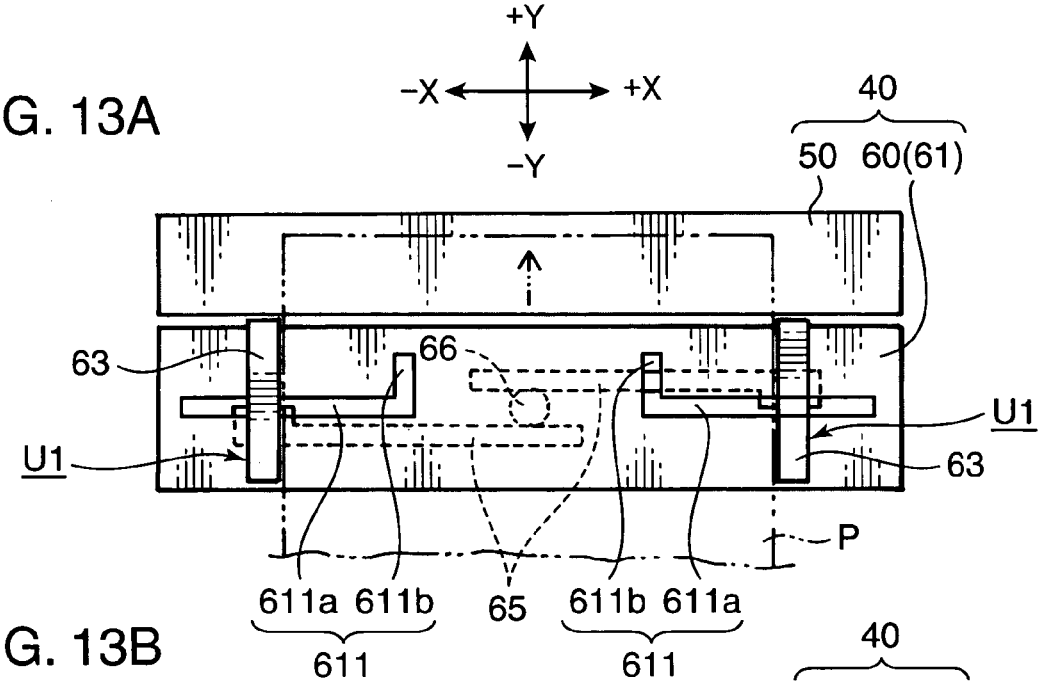
Figure 13B:
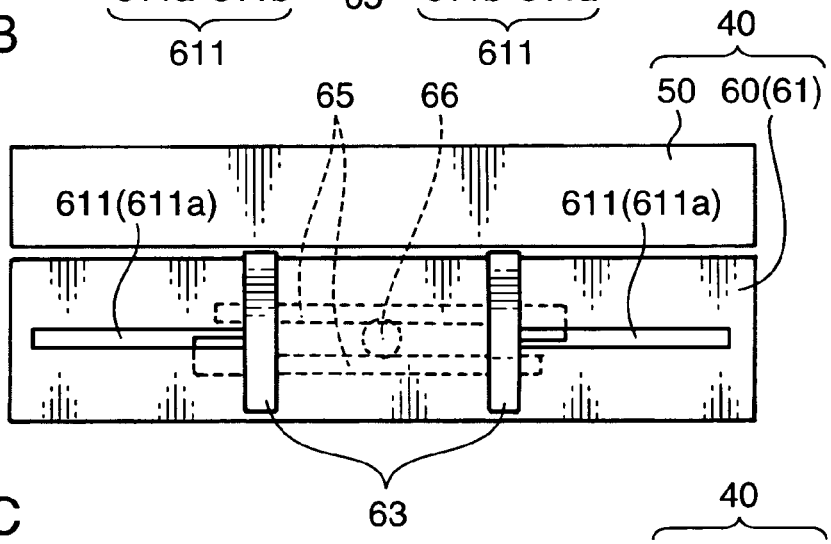
Figure 13C:
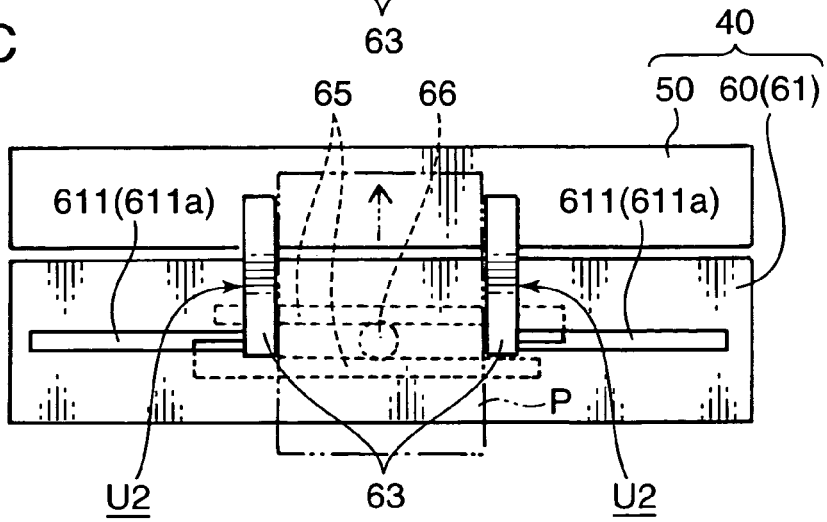

Hereinafter, functions of a manual feeding portion 40 according to the second embodiment are described with reference to FIGS. 13A to 13C and also to FIGS. 1 to 8 if necessary. FIGS. 13A to 13C are plan views of the manual feed tray 61 showing functions of the manual feeding portion 40 according to the second embodiment, wherein FIG. 13A shows a state where the pair of cursors 63 are set at the normal positions U1, FIG. 13B shows a state reached by moving the pair of cursors 63 to positions having a minimum spacing therebetween, and FIG. 13C shows a state where the pair of cursors 63 are set at the downstream positions U2. Directions shown by X and Y in FIG. 13 are the same as in the case of FIG. 1 (transverse directions X (−X: leftward, +X: rightward), forward and backward directions Y (−Y: forward, +Y: backward)).

First, in the state shown in FIG. 13A, the pair of cursors 63 lockingly engaged with the respective cursor supporting members 65 by the hook-shaped locking pieces 69' (see FIG. 12) are set at the normal positions U1 where the cursors 63 are movable along transverse directions while being guided by the widthwise movement guides 611*a*. Thus, a standard sheet of, e.g. A4 size can be manually fed straight.

Upon manually feeding a small-size sheet P such as a postcard, one cursor 63 may be moved the whole way to the forward/backward movement guide 611*b* along the widthwise movement guide 611*a*. Then, the other cursor 63 is moved in an opposite direction by the same distance by way of a pinion member 66, whereby a spacing between the pair of cursors 63 reaches a minimum spacing as shown in FIG. 13B.

In this state, the column-shaped projections 68' (see FIG. 12) of the cursors 63 are disengaged from the hook-shaped locking pieces 69' by pushing the cursors 63 backward as shown by an arrow in FIG. 13B. Thereafter, the cursors 63 are moved backward while the column-shaped projections 68' are guided by the forward/backward movement guides 611*b*, thereby being set at the downstream positions U2 shown in FIG. 13C. In other words, the rear end positions of the cursors 63 are shifted in a sheet conveyance direction.

With the respective cursors 63 set at the downstream positions U2, the downstream ends of the respective cursors 63 are located substantially in the middle part of the fixed tray 50. Accordingly, even in the case of manually feeding a small-size sheet P such as a postcard, this sheet P has the opposite lateral sides thereof guided by the pair of cursors 63 located in the vicinity of a sheet conveyance path 313 (see FIG. 2). Therefore, the small-size sheet P can be fed straight to a registration roller pair 314 (see FIG. 2) without being laterally displaced.

Upon manually feeding a standard sheet P after manually feeding the small-size sheet P, the respective cursors 63 pushed backward may be pulled forward. In this way, the column-shaped projections 68' are engaged with the hook-shaped locking pieces 69' of the cursor supporting members 65. In this state, the cursors 63 may be moved along the widthwise movement guides 611*a* and adjusted to the sheet P of standard size.

The first and second embodiments of the present invention described above may be embodies as follows.

In the foregoing embodiments, the printer 10 is described and illustrated as an image forming apparatus to which the sheet feeding device of the present invention is applied. Instead, the image forming apparatus may be a copier for copying an original image on a sheet P, a facsimile apparatus for printing based on electrically received image information, or a composite apparatus of these.

In the foregoing embodiments, only one sheet cassette 31 is attached to the apparatus main body 11. The number of the sheet cassettes 31 is not limited to one, and sheet cassettes 31 may be detachably provided at a plurality of stages in the apparatus main body 11. In such a case, the manual feeding portion 40 is provided on the uppermost sheet cassette 31.

In the foregoing embodiments, the guiding oblong holes 611 vertically penetrating the manual feed tray 61 are used as guiding portions. The guiding portions are not limited to such guiding oblong holes 611, and may be so-called guide grooves that do not vertically penetrating the manual feed tray 61.

In the foregoing embodiments, the lid 62 of the movable tray 60 completely closes the recessed groove 321, which functions as a feed opening at the time of the manual feeding, with the movable tray 60 set in the accommodated posture S1. Instead, a recess may be formed at a portion of the bottom edge of the front plate 113 of the apparatus main body 11 facing the lid 62. By providing such a recess, the lid 62 of the movable tray 60 set in the accommodated posture S1 can be used as a second manual feed tray. This is very convenient because a sheet P can be manually fed regardless of whether the movable tray 60 is set in the accommodated posture S1 or the withdrawn posture S2.

In the foregoing embodiments, the cursors 63 are freed from the locked state by the cursor supporting members 65 in order to be set at the downstream positions U2. Instead, each cursor 63 may be telescopically constructed by having two parts, and the cursors 63 may be extended upon manually feeding a small-size sheet P. In other words, the positions of the cursors 63 at the front side with respect to the sheet conveyance direction may be shifted toward the apparatus main body 11. With such a construction, it becomes unnecessary to provide the holding structures 67, 67' having particularly complicated constructions, thereby being able to contribute to a reduction in the number of parts.

Third Embodiment

Figure 14A:
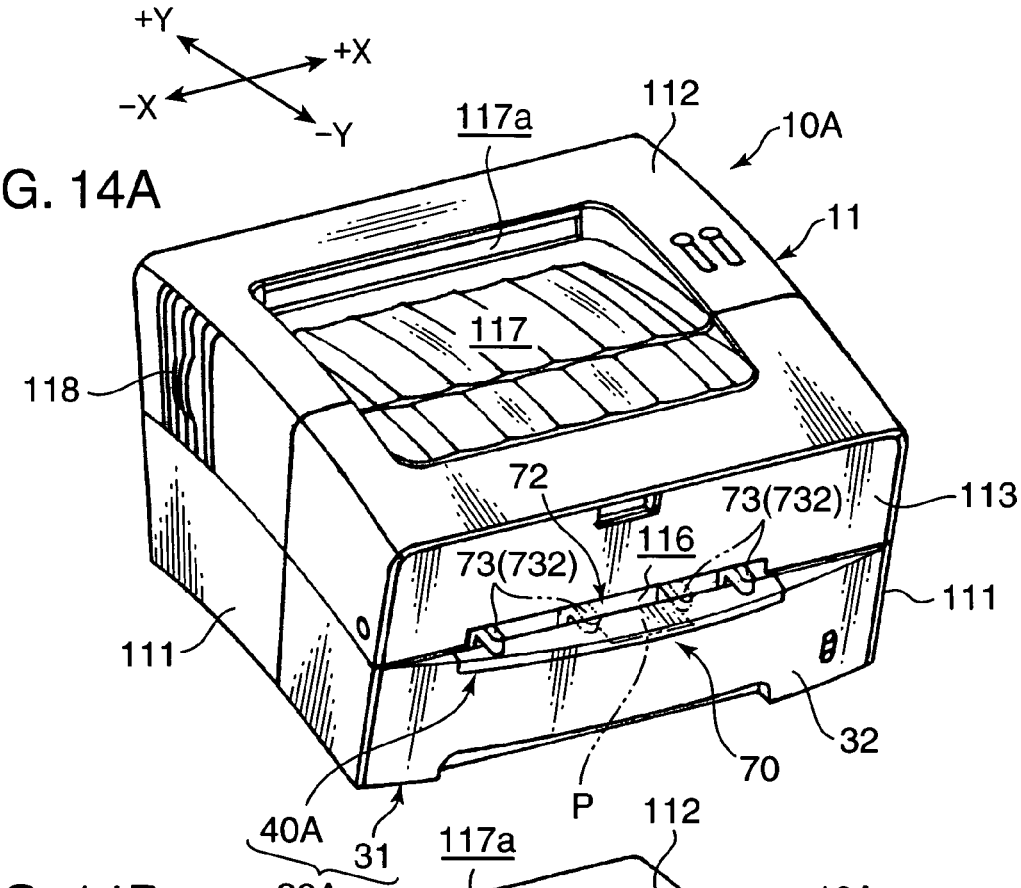
Figure 14B:
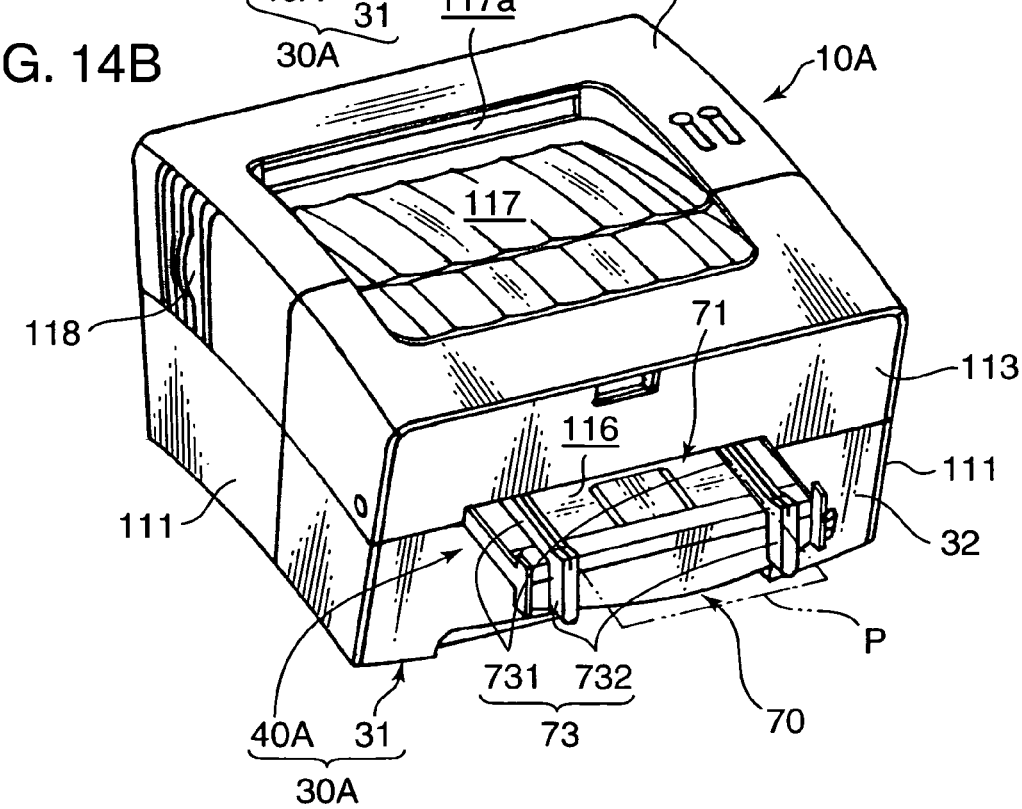

FIGS. 14A, 14B are perspective views showing a printer 10A to which a sheet feeding device 30A according to a third embodiment is applied, wherein FIG. 14A shows a state where a movable tray 70 of a manual feeding portion 40A is set in an accommodated posture and FIG. 14B shows a state where the movable tray 70 is set in a withdrawn posture. The third embodiment concerns the sheet feeding device 30A employing the movable tray 70 constructed to enable the manual sheet feeding in both withdrawn posture and accommodated posture unlike the movable tray 60 employed in the preceding two embodiments.

Figure 15:
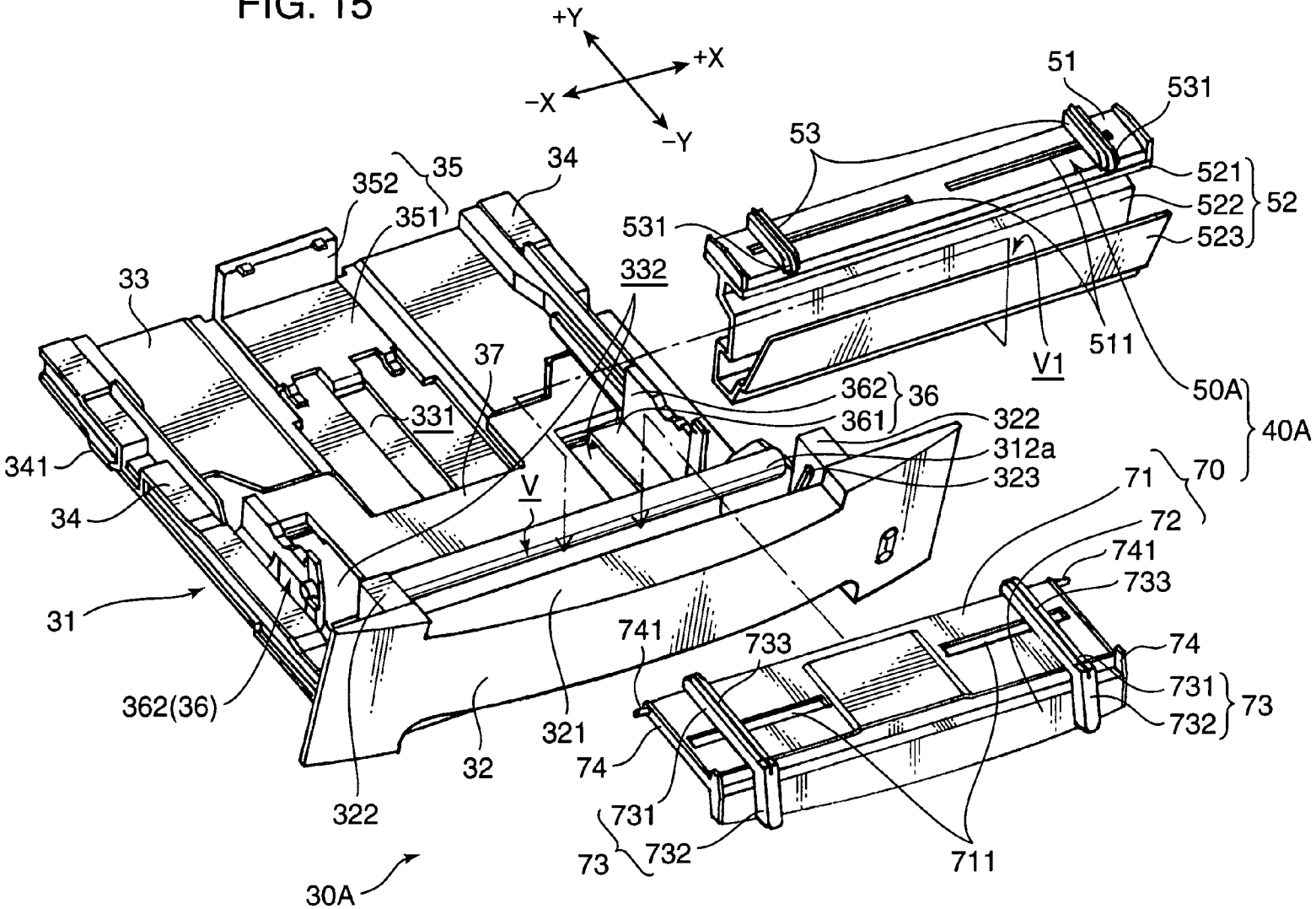
FIG. 15 is an exploded perspective view showing the sheet feeding device according to the third embodiment.
Figure 16:
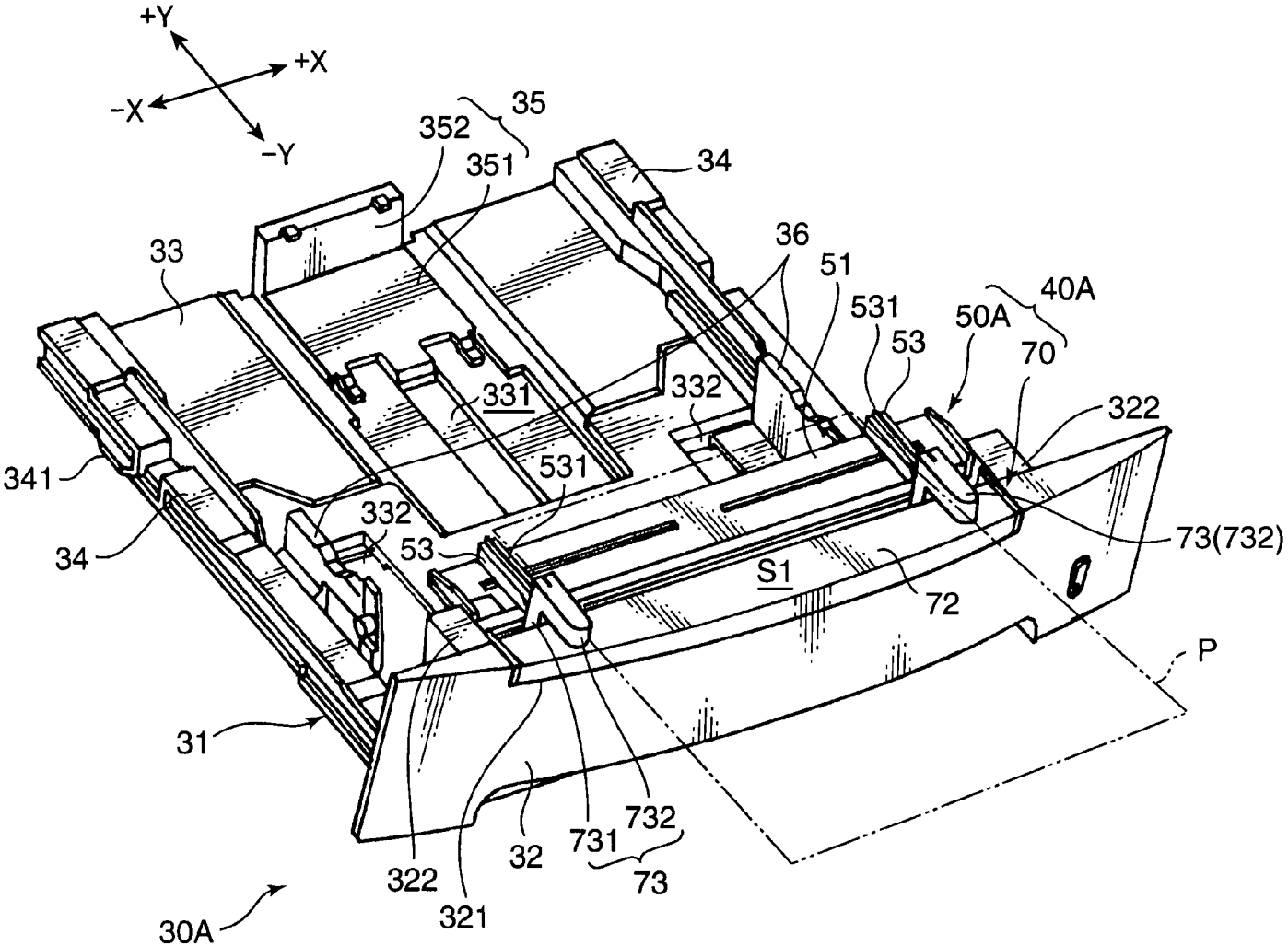
FIG. 16 is a perspective view showing the assembled sheet feeding device shown in FIG. 15 with the movable tray of the manual feeding portion set in the accommodated posture.
Figure 17:
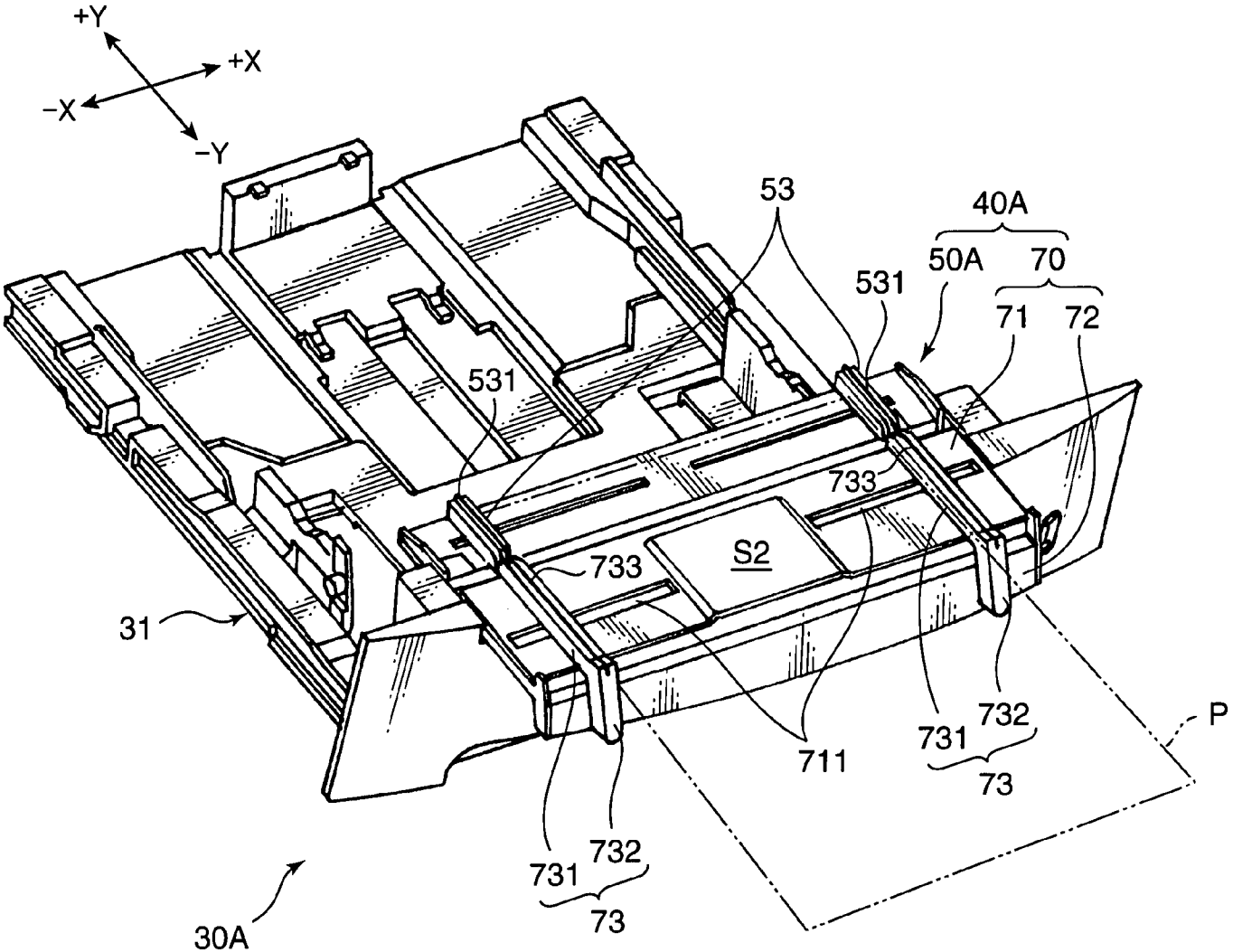
FIG. 17 is a perspective view showing the assembled sheet feeding device shown in FIG. 15 with the movable tray of the manual feeding portion set in the withdrawn posture.

Hereinafter, such a sheet feeding device 30A is described in detail with reference to FIGS. 15 to 17. FIG. 15 is an exploded perspective view of the sheet feeding device 30A, and FIGS. 16 and 17 are perspective views showing the assembled sheet feeding device 30A. FIG. 16 shows a state where the movable tray 70 of the manual feeding portion 40A is set in an accommodated posture S1 and FIG. 17 shows a state where the movable tray 70 of the manual feeding portion 40 is set in a withdrawn posture S2. Directions shown by X and Y in FIGS. 14 to 17 are the same as in the case of FIG. 1 ((transverse directions X (−X: leftward, +X: rightward), forward and backward directions Y (−Y: forward, +Y: backward)). It should be noted that parts similar or identical to the first embodiment described above are only briefly described or not described at all.

The sheet feeding device 30A includes a sheet cassette 31 and the manual feeding portion 40A. The manual feeding portion 40A is provided with a fixed tray 50A located closer to an image forming assembly, and the movable tray 70 connected with the upstream end of the fixed tray 50A. In this embodiment, the movable tray 70 can change the posture thereof between the accommodated posture S1 (see FIG. 16) where the movable tray 70 is accommodated in the sheet cassette 31 and the withdrawn posture S2 (see FIG. 17) where the movable tray 70 is withdrawn from the sheet cassette 31. A sheet P can be manually fed through a feed opening 116 formed in the front surface of the apparatus main body 11 regardless of the set posture of the movable tray 70.

The fixed tray 50A is for guiding a sheet P being manually fed by means of the movable tray 70 to a sheet conveyance path 313 (see FIG. 2) similar to the first embodiment, and includes a tray main body 51 elongated in transverse directions, and a pair of fixed-tray cursors 53 provided on this tray main body 51 movably in transverse directions. The tray main body 51 is formed with a pair of left and right guiding oblong holes 511. The pair of fixed-tray cursors 53 are movable in transverse directions by being guided by the corresponding guiding oblong holes 511.

The front ends of the respective fixed-tray cursors 53 slightly project forward from the tray main body 51, and coupling fins 531 projecting outward and extending in forward and backward directions are provided from the rear surfaces to the upper surfaces of the fixed-tray cursors 53. The coupling fins 531 are for coupling the fixed-tray cursors 53 to movable-tray cursors 73 to be described later.

Such a fixed tray 50A is mounted in an upper part of a mounting space V while being supported by a tray supporting member 52. This tray supporting member 52 includes a tray supporting plate 521, a rear plate 522 and a front plate 523 similar to the first embodiment. The tray main body 51 is closely fixed to the tray supporting member 521.

The movable tray 70 is provided with a first tray 71 (whose outer surface is a first guiding surface) for guiding a sheet P being manually inserted with the movable tray 70 set in the withdrawn posture S2 (see FIG. 17), a second tray 72 (whose outer surface is a second guiding surface) for guiding a sheet P being manually inserted with the movable tray 70 set in the accommodated posture S2 (see FIG. 16), and the pair of left and right movable-tray cursors 73 extending over the first and second trays 71, 72. The second tray 72 is connected with the first tray 71 in a bent-down state in FIG. 15 at the front edge of the first tray 71.

The first tray 71 has a transverse dimension thereof set to be slightly shorter than that of a recessed groove 321 formed in an arched front plate 32 of the sheet cassette 31 while having a width thereof in forward and backward directions set to be considerably longer (about threefold in, this embodiment) than that of the recessed groove 321. By such dimensioning, the first tray 71 projects forward a considerable distance from the arched front plate 32 of the sheet cassette 31 as shown in FIGS. 14B and 17 with the movable tray 70 set in the withdrawn posture S2.

On the contrary, the second tray 72 has a transverse dimension thereof set to be equal to that of the first tray 71 and has a width thereof in forward and backward directions set to be equal to that of the recessed groove 321 over the entire length (i.e. the front part thereof has the same planar shape as the recessed groove 321). By such dimensioning, the second tray 72 only covers the upper part of the recessed groove 321 and does not project forward from the arched front plate 32 of the sheet cassette 31 as shown in FIGS. 14A and 16 with the movable tray 70 set in the accommodated posture S1.

The feed opening 116 (see FIGS. 14A, 14B) of the apparatus main body 11 is not closed in this accommodated posture S1, either. Regardless of the posture of the movable tray 70, a sheet P can be manually fed into the apparatus main body 11 through this feed opening 116.

Each movable-tray cursor 73 is L-shaped in conformity with the outer surfaces of the first and second trays 71, 72 and comprised of a first cursor 731 (first cursor) corresponding to the width of the first tray 71 in the sheet conveyance direction and a second cursor 732 (second cursor) corresponding to the width of the second tray 72 in the sheet conveyance direction. Such movable-tray cursors 73 are movable in opposite directions while the first cursors 731 are guided along corresponding guiding oblong holes 711 formed in the first tray 71 and extending in transverse direction. Thus, a spacing between the inner sides of the first cursors 731 and the one between the inner sides of the second cursors 732 can conform to the width of a sheet P to be manually fed.

Guidable shafts 741 project in opposite directions at rear end positions of reinforcing members 74 mounted at the opposite ends of the movable tray 70 in FIG. 15. On the other hand, a pair of side walls 322 provided on the backside of the arched front plate 32 are formed with guiding grooves 323 facing each other and vertically extending. The respective guidable shafts 741 are fitted into the corresponding guiding grooves 323. Thus, the movable tray 70 can change the posture thereof between the accommodated posture S1 (see FIG. 16) where the first tray 71 is accommodated in an accommodation space V1 and the withdrawn posture S2 (see FIG. 17) where the first tray 71 is withdrawn from the accommodation space V1 to become in flush with the tray main body 51 of the fixed tray 50A while the respective guidable shafts 741 are guided by the corresponding guiding grooves 323.

Coupling grooves 733 which extend in forward and backward directions and into which the coupling fins 531 provided on the fixed-tray cursors 53 of the fixed tray 50A are fittable are formed on the upper surface of the first cursors 731 of the movable-tray cursors 73. The coupling grooves 733 are engaged with the coupling fins 531 from the outside with the guidable shafts 741 of the first tray 71 fitted in the guiding grooves 323 of the side walls 322 of the sheet cassette 31. This engaged state is kept independently of the posture of the movable tray 70.

Accordingly, the movable-tray cursors 73 and the fixed-tray cursors 53 are coupled to each other by way of the coupling grooves 733 and the coupling fins 531 both in the state where the movable tray 70 is set in the accommodated posture S1 as shown in FIG. 16 and in the state where the movable tray 70 is set in the withdrawn posture S2 as shown in FIG. 17. Thus, regardless of the set posture of the movable tray 70, the fixed-tray cursors 53 can be also moved by moving the movable-tray cursors 73.

Figure 18A:
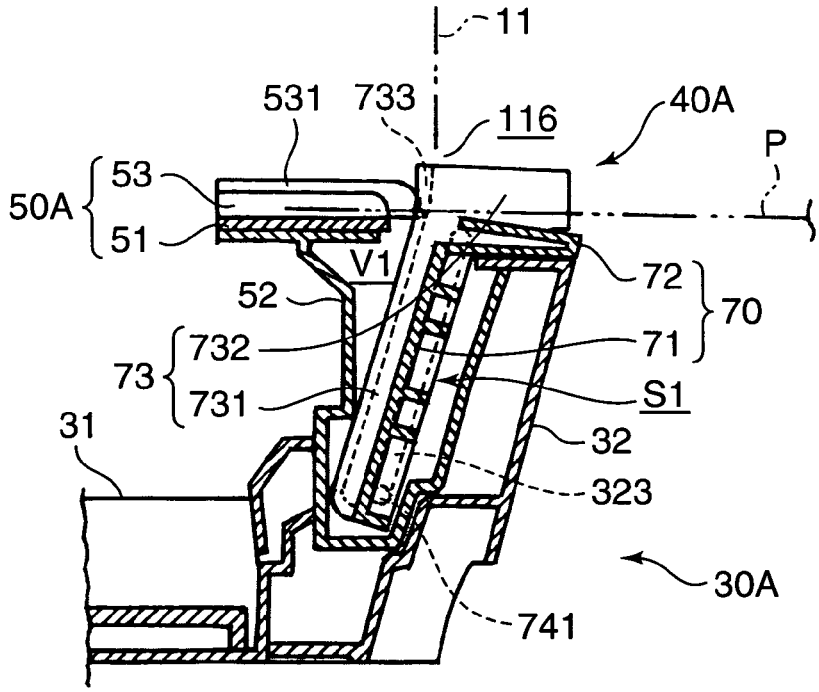
Figure 18B:
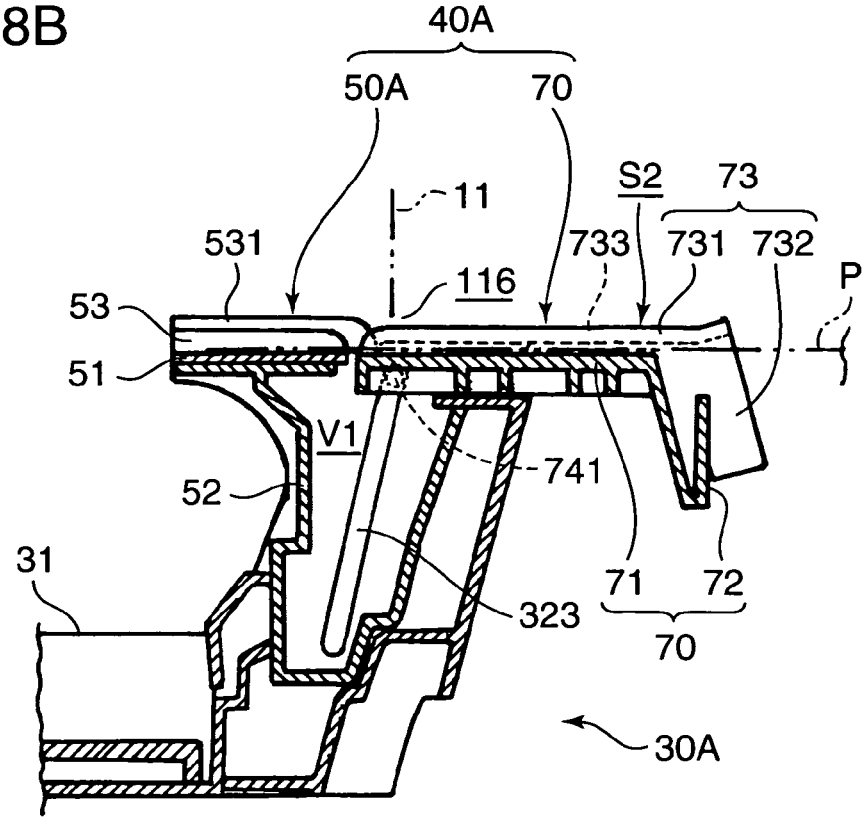

FIGS. 18A and 18B are sections showing functions of the manual feeding portion 40A according to the third embodiment, wherein FIG. 18A shows a state where the movable tray 70 is set in the accommodated posture S1 and FIG. 18B shows a state where the movable tray 70 is set in the withdrawn posture S2.

First, with the movable tray 70 set in the accommodated posture S1, the first tray 71 of the movable tray 70 is accommodated in the accommodation space V1 of the sheet cassette 31. Thus, the right end surface of the second tray 72 in FIG. 18A is in flush with the right surface of the arched front plate 32 of the sheet cassette 31 and does not bulge out. Also, the upper surface of the second tray 72 is flush with the upper surface of the tray main body of the fixed tray 50A. At this time, the second cursors 732 integral to the first cursors 731 and the fixed-tray cursors 53 are set at the same positions with respect to forward and backward directions (directions normal to plane of FIG. 18A) by the engagement of the coupling grooves 733 formed in the first cursors 731 with the coupling fins 531 of the fixed tray 70A from the outside.

Accordingly, with the movable tray 70 set in the accommodated posture S1, a sheet P can be fed through the feed opening 116 via the second tray 72 of the movable tray 70 and the fixed tray 50A. This state is suitable to feed a small-size sheet P such as a postcard since the length of the second cursors 732 is relatively short.

Subsequently, when the movable tray 70 is pulled upward after the sheet cassette 31 is withdrawn from the apparatus main body 11 with the movable tray 70 set in the accommodated posture S1 shown in FIG. 18A, the movable tray 70 is stably pulled out of the accommodation space V1 while the guidable shafts 741 are guided by the guiding grooves 323.

The movable tray 70 can be displaced to the withdrawn posture S2 as shown in FIG. 18B by rotating the movable tray 70 in clockwise direction about the guidable shafts 741 with the guidable shafts 741 held in contact with the upper edges of the guiding grooves 323. In this state, the sheet cassette 31 detached from the main body 11 is pushed into the apparatus main body 11. This enables a sheet P to be manually fed via the movable tray 70.

During this posture change, the coupling grooves 733 of the first cursors 731 remain engaged with the coupling fins 531 of the fixed-tray cursors 53 from the outside. Thus, there is no likelihood of destroying the positional relationship of the movable-tray cursors 73 with the fixed-tray cursors 53.

With the movable tray 70 set in the withdrawn posture S2, the right side of the first tray 71 and the second tray 72 of the movable tray 70 project rightward from the apparatus main body 11. Since the upper surface of the first tray 71 is in flush with the upper surfaces of the fixed-tray cursors 53, a sheet P can be manually fed while being placed on the upper surface of the first tray 71 and those of the fixed-tray cursors 53.

In this way, the movable tray 70 projects a considerable distance from the apparatus main body 11 with the movable tray 70 set in the withdrawn posture S2. Specifically, the first tray 71 long in the sheet conveyance direction is connected with the feed opening 116 and the sheet P can be guided by the first cursors 731 longer than the second cursors 732. In other words, the rear end positions of the movable-tray cursors 73 with respect to the sheet displaying direction are shifted backward. Accordingly, this state is suitable to feed standard sheets such as sheets P of A4 size.

As described in detail above, the sheet feeding device 30A according to the third embodiment includes the sheet cassette 31 detachably attached to the apparatus main body 11 of the printer 10A and storing a plurality of sheets P, and the movable tray 70 can change the posture thereof between the accommodated posture S1 where the movable tray 70 is accommodated in the sheet cassette 31 and the withdrawn posture S2 where the movable tray 70 is withdrawn from the sheet cassette 31. The movable tray 70 includes the first tray 71 having a guiding surface for guiding the sheet P in the withdrawn posture S2 and having a relatively long dimension in the sheet conveyance direction, and the second tray 72 having a guiding surface for guiding the sheet P in the accommodated posture S1 and having a relatively short dimension in the sheet conveyance direction. Each movable-tray cursor 73 is comprised of the first cursor 731 corresponding to the size of the first tray 71 and the second cursor 732 corresponding to the size of the second tray 72.

With such a construction, upon manually feeding a sheet P into the apparatus main body 11 by way of the manual feeding portion 40A of the sheet feeding device 30A, the sheet P can be fed regardless of whether the manual feeding portion 40A is set in the accommodated posture S1 where it is accommodated in the sheet cassette 31 or in the withdrawn posture S2 where it is withdrawn from the sheet cassette 31.

Upon feeding a small-size sheet P such as a postcard, the sheet P can be directly fed by way of the manual feeding portion 40A set in the accommodated posture S1 without performing such a cumbersome operation of withdrawing the manual feeding portion 40A set in the accommodated posture S1 from the sheet cassette 31 accommodated in the apparatus main body 11 to change the posture of the manual feeding portion 40A to the withdrawn posture S2.

Contrary to this, upon manually feeding a sheet P of standard size such as A4 size, the sheet P of standard size can be smoothly manually fed without being laterally displaced by withdrawing the manual feeding portion 40A in the accommodated posture S1 from the sheet cassette 31 to set it in the withdrawn posture S2.

Accordingly, a user can selectively set the posture of the manual feeding portion 40A depending on the size of a sheet P to be manually fed and a situation. Thus, the sheet feeding device 30A can be made very versatile and convenient.

In the third embodiment, the fixed tray 50A is disposed right downstream of the movable tray 70. However, the fixed tray 50A may be omitted depending on the situation (e.g. a case where the length of the movable tray 70 in the sheet conveyance direction is sufficiently long).

Fourth Embodiment

Figure 19:
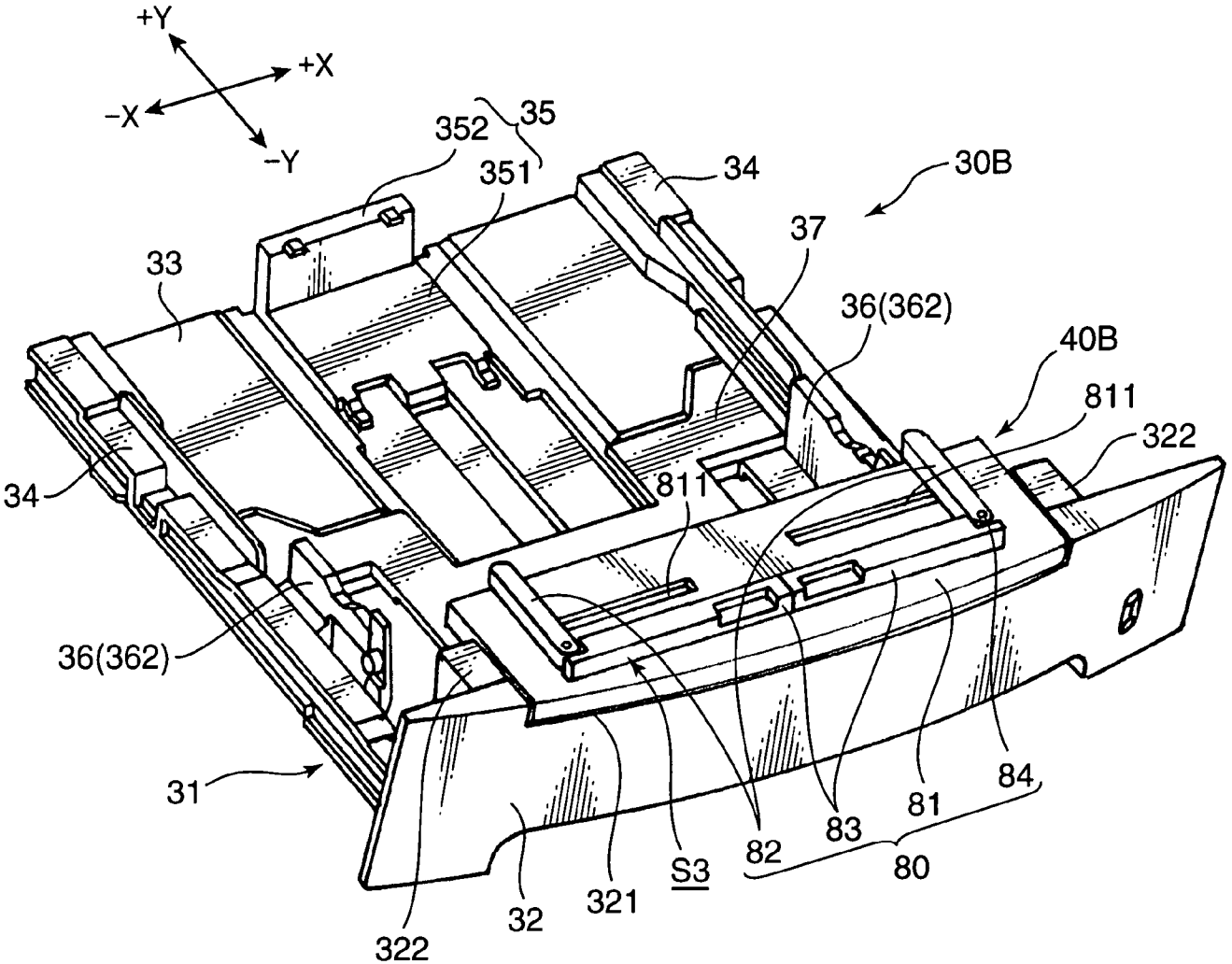
FIG. 19 is a perspective view showing a sheet feeding device according to a fourth embodiment.
Figure 20:
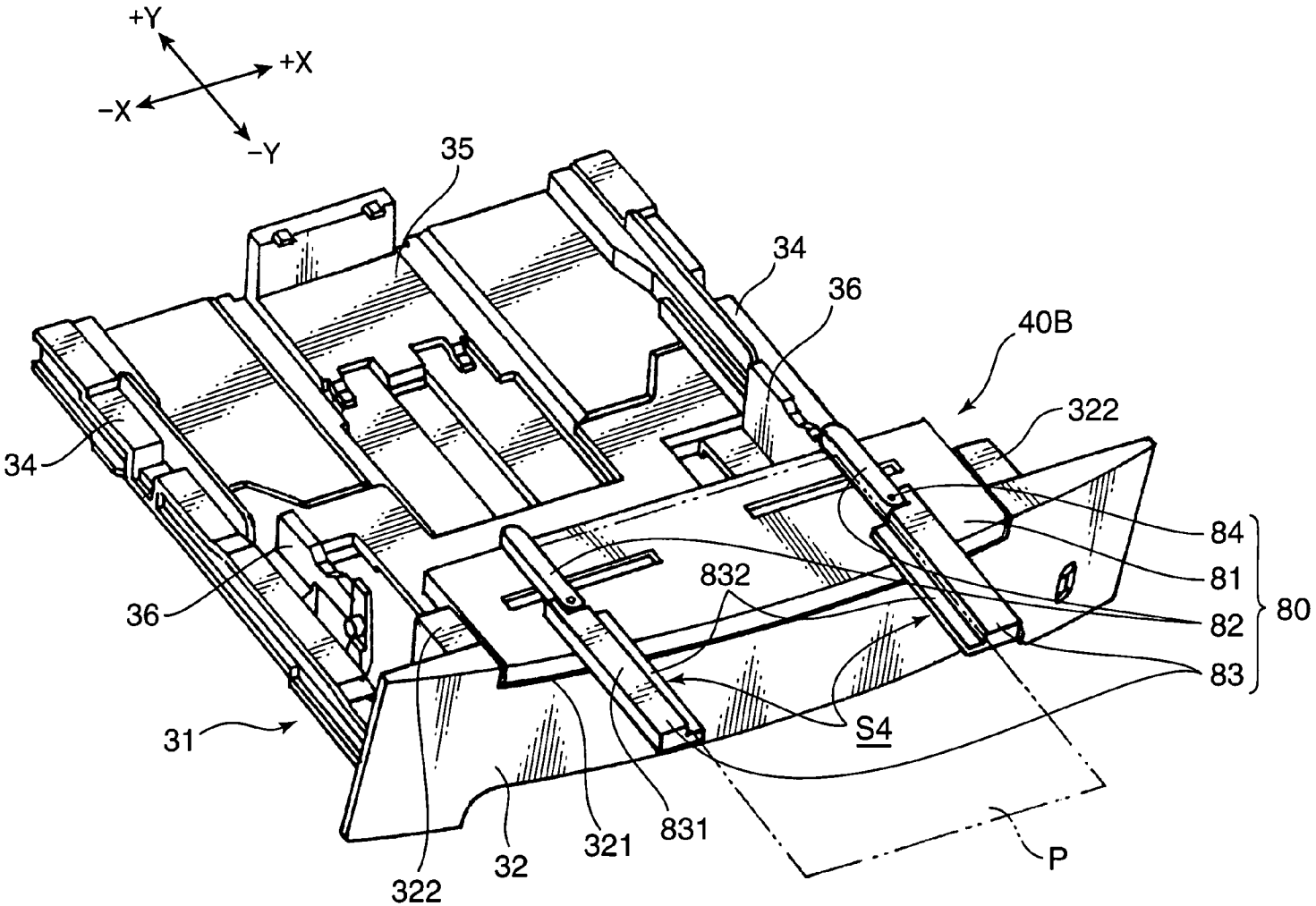
FIG. 20 is a perspective view showing the sheet feeding device according to the fourth embodiment with cursors extended.

FIGS. 19, 20 are perspective views showing a sheet feeding device 30B according to a fourth embodiment. In the sheet feeding device 30B of this embodiment, the rear end positions of cursors arranged in a manual feeding portion with respect to a sheet conveyance direction are shiftable by making the cursors bendable.

This sheet feeding device 30B includes a sheet cassette 31 similar to those of the foregoing embodiments, and a manual feeding portion 40B. The manual feeding portion 40B is provided with an unillustrated tray supporting member, and a manual feed tray 80 mounted on the tray supporting member. It should be noted that FIG. 19 shows a state where the manual feed tray 80 is set in a closed posture S3 and FIG. 20 shows a state where the manual feed tray 80 is set in an opened posture S4.

The manual feed tray 80 is comprised of a tray main body 81 in the form of a flat plate whose front edge has the same arcuate shape as an arched front plate 32, a pair of left and right back side cursors 82 (third cursors) moving in opposite directions along transverse directions on the upper surface of the tray main body 81, a pair of left and right feed-opening side cursors 83 (fourth cursors) connected with the front ends of the respective back side cursors 82, and connecting shafts 84 rotatably connecting the feed-opening side cursors 83 with the back side cursors 82.

The tray main body 81 is formed with a pair of left and right guiding oblong holes 811 extending in transverse directions at substantially middle positions in forward and backward directions. The respective guiding oblong holes 811 are for guiding the movements of the respective back side cursors 82 in opposite directions along transverse directions, and are offset to each other so as not to interfere in forward and backward directions. It should be noted that these guiding oblong holes 811 may be widened like the guiding oblong holes 611 shown in FIG. 6 or may be L-shaped like the guiding oblong holes 611' shown in FIG. 10 to enable the back side cursors 82 to move along the sheet conveyance direction.

The back side cursors 82 are simultaneously moved by the same distance in opposite directions along transverse directions while being guided by the guiding oblong holes 811. The length of the back side cursors 82 is set such that the back ends of the back side cursors 82 slightly project backward from the rear edge of the tray main body 81, and the front ends thereof are located at positions slightly retracted backward from the front edge of the tray main body 81.

One end of each feed-opening side cursor 83 is connected with the corresponding back side cursors 82 via the connecting shaft 84. The pair of feed-opening side cursors 83 are bent relative to the corresponding back-side cursors 82 with the connecting shafts 84 as pivots, thereby being able to change the postures thereof between the closed postures S3 (see FIG. 19) where the leading ends of the cursors 83 abut on each other and the opened postures S4 (see FIG. 20) where the back-side cursors 82 and the corresponding feed-opening cursors 83 are brought into line with each other. Each feed-opening side cursor 83 is comprised of a prism-shaped cursor main body 831 and a projecting edge portion 832 projecting toward the other cursor 83 from a bottom part of the inner surface of the cursor main body 831 to support a sheet.

Figure 21A:
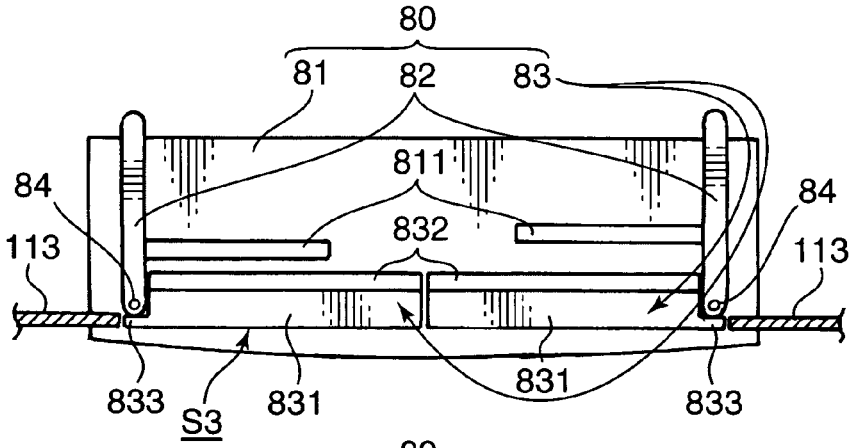
Figure 21B:
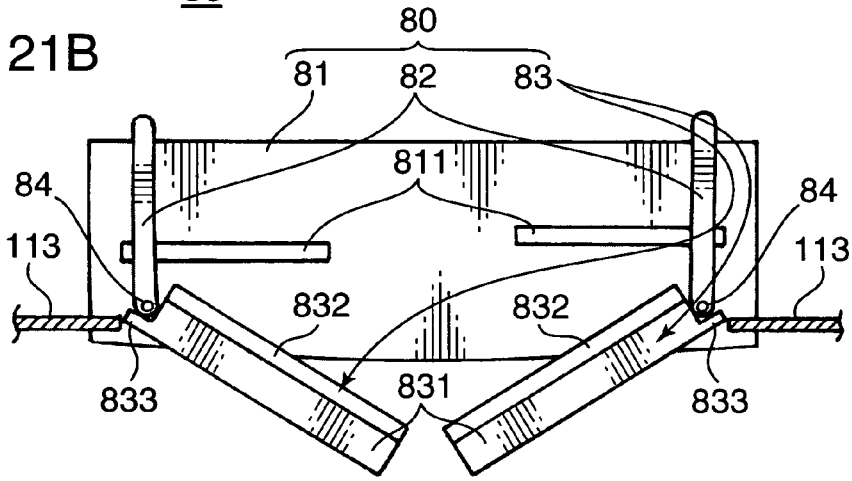
Figure 21C:
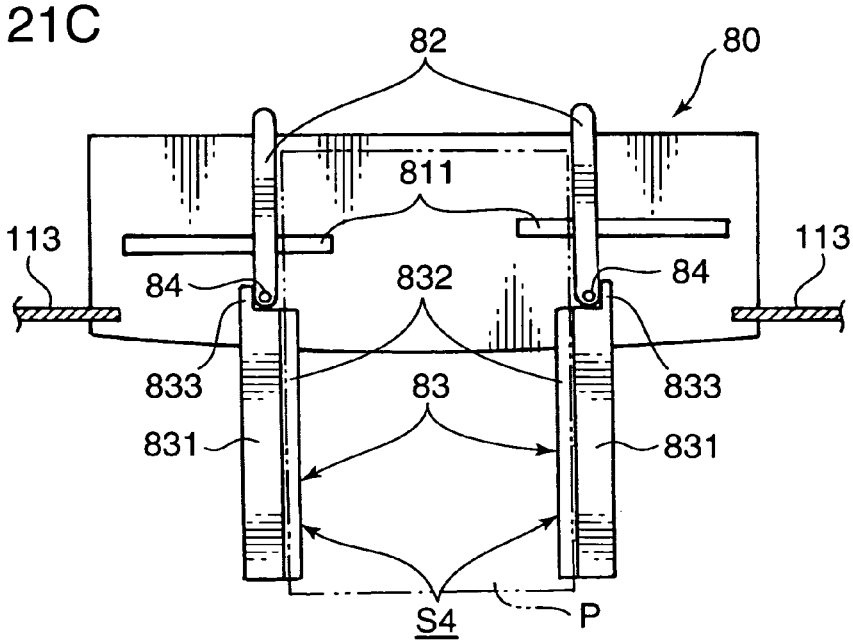

Hereinafter, functions of the manual feeding portion 40B according to the fourth embodiment are described with reference to FIGS. 21A to 21C, wherein FIG. 21A shows a state where the feed-opening side cursors 83 are set in the closed postures S3, FIG. 21B shows an intermediate state during the posture change of the feed-opening side cursors 83 from the closed postures S3 to the opened postures S4, and FIG. 21C shows a state where the feed-opening side cursors 83 are set in the opened postures S4.

First, with the pair of feed-opening side cursors 83 set in the closed postures S3, the feed opening formed in a front plate 113 of the apparatus main body 11 is closed by these feed-opening side cursors 83, whereby no sheet can be manually fed. In conformity with this state, the pair of back side cursors 82 are set at positions having a maximum spacing therebetween. It should be noted that the back side cursors 82 may project forward from the front plate 113 of the apparatus main body 11 so that a sheet P can also be manually fed in this closed posture S3.

Upon manually feeding a sheet P into the apparatus main body 11, the feed-opening side cursors 83 are opened at their hinges as shown in FIG. 21B. Thus, the feed-opening side cursors 83 turn in opposite directions about the connecting shafts 84. At this time, stoppers 833 of the feed-opening side cursors 83 come to interfere with the left and right edges of the feed opening (i.e. with the front plate 113). Thus, the respective back side cursors 82 slightly move in directions toward each other in order to avoid this interference as shown in FIG. 21B.

The respective feed-opening side cursors 83 are brought into line with the corresponding back side cursors 82 to be set in the opened postures S4. At this time, the feed-opening side cursors 83 project backward with respect to the sheet conveyance direction. In other words, the rear end positions of the cursors 83 are shifted along the sheet conveyance direction. Thereafter, the spacing between the feed-opening side cursors 83 is adjusted in conformity with the width of the sheet P. Therefore, the sheet P is supported utilizing the projecting edge portions 832 of the feed-opening side cursors 83 as shown in FIG. 21C, thereby enabling the manual sheet feeding.

Conversely, upon closing the pair of feed-opening side cursors 83 set in the opened postures S4, the respective feed-opening side cursors 83 may be turned in opposite directions about the connecting shafts 84 to be brought closer to each other after the pair of back side cursors 82 are respectively moved to the maximally spaced-apart positions. In this way, the pair of feed-opening side cursors 83 return to the state of FIG. 21A again to close the feed opening.

According to the sheet feeding device 30B of the fourth embodiment as above, the manual feed tray 80 is provided with the pair of feed-opening side cursors 83 extendable in the sheet conveyance direction and facing each other for suppressing widthwise displacements of the sheet P. The feed-opening side cursors 83 can change their postures between the closed postures S3 in which the cursors 83 close the feed opening and the opened postures S4 in which the cursors 83 are withdrawn from the feed opening and parallel to each other to tightly hold the sheet P therebetween. Accordingly, upon manually feeding a sheet P, the feed-opening side cursors 83 set in the closed postures S3 are withdrawn from the sheet cassette 31 to be set in the opened postures S4 where the feed-opening side cursors 83 are parallel to each other to tightly hold the sheet P therebetween. Therefore, the sheet P is fed straight without being laterally or obliquely displaced while being guided by the pair of feed-opening side cursors 83.

This application is based on patent application Nos. 2005-206763, 2005-207272 and 2005-207289 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet feeding device for manually feeding a sheet into a specified apparatus, comprising:

a manual feed tray for guiding a sheet being manually fed;

a pair of cursor members provided on the manual feed tray and being movable in opposite directions along a sheet width direction normal to a sheet conveyance direction so that a spacing between the cursor members is shiftable from a predetermined first distance to a predetermined second distance different from the first distance in accordance with a width of a sheet, and the pair of cursor members being movable along the sheet conveyance direction in a state such that the second distance is maintained.

2. A sheet feeding device according to claim 1, wherein the pair of cursor members are movable along the sheet conveyance direction only when the cursor members are at the second distance from one another.

3. A sheet feeding device according to claim 2, wherein the manual feed tray includes a pair of guiding portions for guiding movements of the pair of cursor members, and the guiding portions have such a dimension in forward and backward directions as to permit movements of the cursor members along the sheet conveyance direction.

4. A sheet feeding device according to claim 2, wherein the manual feed tray includes a pair of guiding portions for guiding movements of the pair of cursor members, and each of the pair of guiding portions has a widthwise movement guide extending in the sheet width direction and a forward/backward movement guide for moving the corresponding cursor member in the sheet conveyance direction from a portion of the widthwise movement guide closest to the other widthwise movement guide.

5. A sheet feeding device according to claim 4, further comprising cursor supporting members movable by being guided by the widthwise movement guides while supporting the corresponding cursor members, the cursor members being detached from the cursor supporting members and guided by the forward/backward movement guides with the positions thereof set to have a minimum spacing therebetween.

6. A sheet feeding device according to claim 2, further comprising a fixed tray extended up to the upstream end of a specified processing device for sheets in the specified apparatus, the manual feed tray being able to change the posture thereof between an accommodated posture where the manual feed tray closes the upstream end of the fixed tray and a withdrawn posture reached by withdrawing the manual feed tray in the accommodated posture toward an upstream side with respect to the sheet conveyance direction to be connected with the fixed tray.

7. A sheet feeding device according to claim 1, further comprising a sheet cassette detachably attached to the specified apparatus, wherein:

the manual feed tray can change the posture thereof between an accommodated posture where the manual feed tray is accommodated in the sheet cassette and a withdrawn posture where the manual feed tray is withdrawn from the sheet cassette, and includes a first guiding surface having a specified width along the sheet conveyance direction and adapted to guide a sheet in the withdrawn posture and a second guiding surface having a shorter width along the sheet conveyance direction than the first guiding surface and adapted to guide a sheet in the accommodated posture, and each cursor member includes a first cursor corresponding to the width of the first guiding surface and a second cursor corresponding to the width of the second guiding surface, the rear end position of each cursor member with respect to the sheet conveyance direction being shifted along the sheet conveyance direction as the posture of the manual feed tray is changed between the accommodated posture and the withdrawn posture.

8. A sheet feeding device according to claim 1, wherein each cursor member includes a third cursor arranged on the manual feed tray and a fourth cursor coupled to the third cursor, the fourth cursor being able to change the posture thereof between a first posture where the fourth cursor is at an angle to the third cursor and a second posture where the fourth cursor is brought into line with the third cursor, and the rear end positions of the cursor members with respect to the sheet conveyance direction being shifted along the sheet conveyance direction as the postures of the fourth cursors are changed between the first postures and the second postures.

9. A sheet feeding device according to claim 1, wherein the manual feed tray includes widthwise movement guides aligned and configured for guiding movement of the cursor members in the sheet width direction while preventing movement of the cursor members in the sheet conveyance direction along a part of a range of movement of the cursor members in the sheet width direction.

10. A sheet feeding device according to claim 1, wherein the manual feed tray includes forward/backward movement guides aligned and configured for guiding movement of the cursor members in the sheet conveyance direction when the cursor members have the second distance therebetween.

11. A sheet feeding device for manually feeding a sheet into an apparatus main body of an image forming apparatus, comprising:

a manual feed tray for guiding a sheet being manually fed;

a pair of cursor members provided on the manual feed tray and movable in opposite directions along a sheet width direction normal to a sheet conveyance direction so that a spacing between the cursor members is shiftable from a predetermined first distance to a predetermined second distance different from the first distance in accordance with a width of a sheet, and the pair of cursor members further being movable along the sheet conveyance direction in a state that the second distance is maintained.

12. An image forming apparatus, comprising:

an apparatus main unit internally including a transfer device for transferring a toner image to a specified sheet, and a sheet feeding device for feeding a manually fed sheet to the transfer device, the sheet feeding device including:

a manual feed tray for guiding a sheet being manually fed, and a pair of cursor members provided on the manual feed tray and movable in opposite directions along a sheet width direction normal to a sheet conveyance direction in accordance with the width of the sheet, the pair of cursor members being operable such that the front end position and/or the rear end positions thereof with respect to the sheet conveyance direction are shifted along the sheet conveyance direction.

13. An image forming apparatus according to claim 12, wherein the pair of cursor members are movable along the sheet conveyance direction.

14. An image forming apparatus according to claim 13, wherein the manual feed tray includes a pair of guiding portions for guiding movements of the pair of cursor members, and the guiding portions have such a dimension in forward and backward directions as to permit movements of the cursor members along the sheet conveyance direction.

15. An image forming apparatus according to claim 13, wherein the manual feed tray includes a pair of guiding portions for guiding movements of the pair of cursor members, and each of the pair of guiding portions has a widthwise movement guide extending in the sheet width direction and a forward/backward movement guide for moving the corresponding cursor member in the sheet conveyance direction from a portion of the widthwise movement guide minimally distanced from the other widthwise movement guide.

16. An image forming apparatus according to claim 15, further comprising cursor supporting members movable by being guided by the widthwise movement guides while supporting the corresponding cursor members, the cursor members being detached from the cursor supporting members and guided by the forward/backward movement guides with the positions thereof set to have a minimum spacing therebetween.

17. An image forming apparatus according to claim 13, further comprising a fixed tray extended up to the upstream end of the transfer device in the apparatus main body, the manual feed tray being able to change the posture thereof between an accommodated posture where the manual feed tray closes the upstream end of the fixed tray and a withdrawn posture reached by withdrawing the manual feed tray in the accommodated posture toward an upstream side with respect to the sheet conveyance direction to be connected with the fixed tray.

18. An image forming apparatus according to claim 13, further comprising a sheet cassette detachably attached to the apparatus main body, wherein:

the manual feed tray can change the posture thereof between an accommodated posture where the manual feed tray is accommodated in the sheet cassette and a withdrawn posture where the manual feed tray is withdrawn from the sheet cassette.

19. An image forming apparatus according to claim 12, further comprising a sheet cassette detachably attached to the apparatus main body, wherein:

the manual feed tray can change the posture thereof between an accommodated posture where the manual feed tray is accommodated in the sheet cassette and a withdrawn posture where the manual feed tray is withdrawn from the sheet cassette, and includes a first guiding surface having a specified width along the sheet conveyance direction and adapted to guide a sheet in the withdrawn posture and a second guiding surface having a shorter width along the sheet conveyance direction than the first guiding surface and adapted to guide a sheet in the accommodated posture, and each cursor member includes a first cursor corresponding to the width of the first guiding surface and a second cursor corresponding to the width of the second guiding surface, the rear end position of each cursor member with respect to the sheet conveyance direction being shifted along the sheet conveyance direction as the posture of the manual feed tray is changed between the accommodated posture and the withdrawn posture.

20. An image forming apparatus according to claim 12, wherein each cursor member includes a third cursor arranged on the manual feed tray and a fourth cursor coupled to the third cursor, the fourth cursor being able to change the posture thereof between a first posture where the fourth cursor is at an angle to the third cursor and a second posture where the fourth cursor is brought into line with the third cursor, and the rear end positions of the cursor members with respect to the sheet conveyance direction being shifted along the sheet conveyance direction as the postures of the fourth cursors are changed between the first postures and the second postures.

* * * * *